US008033844B2

(12) United States Patent
Kobayashi et al.

(10) Patent No.: US 8,033,844 B2
(45) Date of Patent: Oct. 11, 2011

(54) LEVER TYPE CONNECTOR

(75) Inventors: Kohtaro Kobayashi, Kanagawa (JP); Naoya Matsuura, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/937,778

(22) PCT Filed: Apr. 3, 2009

(86) PCT No.: PCT/US2009/039468

§ 371 (c)(1),
(2), (4) Date: Oct. 14, 2010

(87) PCT Pub. No.: WO2009/129062

PCT Pub. Date: Oct. 22, 2009

(65) Prior Publication Data

US 2011/0053405 A1 Mar. 3, 2011

(30) Foreign Application Priority Data

Apr. 14, 2008 (JP) ..... 2008-104197

(51) Int. Cl.
*H01R 13/62* (2006.01)

(52) U.S. Cl. ..... 439/157

(58) Field of Classification Search ..... 439/157, 439/347, 489, 752, 595, 701
See application file for complete search history.

(56) References Cited

U.S. PATENT DOCUMENTS 5,823,809 A * 10/1998 Wakata ..... 439/157
5,829,994 A * 11/1998 Oda et al. ..... 439/157
6,315,585 B1 * 11/2001 Oka ..... 439/157

* cited by examiner

*Primary Examiner* — Tulsidas Patel
*Assistant Examiner* — Phuong Nguyen
(74) *Attorney, Agent, or Firm* — Timothy M. Morella

(57) ABSTRACT

A connector comprises housing, a lever and a lock portion. The lever, attached to the housing, is configured to be rotatable between a first position, where the connector is initially fit to another is established, and a second position, where the fitting is completed. The lock portion is capable of locking the lever at the second position, is slidably attached to a body portion of the lever, and is configured to be slid between a lock position (where the lever is locked) and a lock release position (re-leased). The lever is provided with a positioning latch-portion, which is configured to latch the lock portion at the lock position and the lock release position and is pro-vided with a concaved latch-portion and a convexed latch-portion that is configured to be elastically displaced to be engaged in or disengaged from the concaved latch-portion.

12 Claims, 22 Drawing Sheets

LEVER TYPE CONNECTOR

BACKGROUND OF THE INVENTION

1. Field of the Invention

The Present Invention relates generally to a connector, and, more particularly, to a connector having a lockable engagement mechanism so as to maintain connection, even when subjected to an unexpected external force.

2. Description of the Related Art

Conventional connectors may be engaged, usually through "tight fitting," with a counterpart connector arranged on a side wall of a casing used for accommodating an electronic device, such as a control unit. Such connectors are typically provided with an engagement lever, which has an engagement groove, disposed to be pivoted in a state where the engagement groove is mated with an engagement projection arranged on a housing of the counterpart connector. In this manner, the fitting force is increased to result in a secure engagement between the connectors. An example of a typical conventional connector can be found in Japanese Patent Application Laid-Open (Kokai) No. 2006-114357.

FIG. 28 is a perspective view of a conventional connector assembly (i.e., a connector and a counterpart connector. In FIG. 28, socket-side connector 801 is connected to an extreme end of a non-illustrated conductive cable. Socket-side connector 801 is engaged, by tight fitting, to plug-side connector 901 as a counterpart connector. Plug-side connector 901 has plug body 912, which receives plurality of plug contacts 961, and frame 911, to which plug body 912 is inserted. At an inside of each of two opposite side surfaces of frame 911, two engagement projections 918 (four in total) are connected so as to inwardly project.

Likewise, socket-side connector 801 has socket body 811, which receives plurality of socket contacts 861, and socket-side casing 821, which encases socket body 811. Socket casing 821 has opening portions 828*a* and 828*b* formed therein for allowing conductive cables to pass through. In each of opposite side walls 824 of socket casing 821, two engagement grooves 883 (four in total) are formed so that engagement projections 918 of plug-side connector 901 can be received in corresponding engagement grooves 833.

Engagement lever 881, for tightly fitting connectors 801, 901, is mounted to be engaged, at an end portion thereof, to sliding groove 815 formed between two engagement grooves 883 (formed in each of side walls 824) so that the above-mentioned end portion thereof can slide along sliding groove 815. When engagement lever 881 is pivoted to be moved from an initial position to a fitting completion position in a state where connectors 801, 901 are engaged with each other, a concave engagement portion of a non-illustrated engagement plate connected to the end portion of engagement lever 881 is engaged with engagement projections 918 of plug-side connector 901, as they are received in engagement grooves 883. Engagement projections 918 are then relatively moved along the side walls of the concave engagement portion, so that plug-side connector 901 is pulled toward socket-side connector 801 to be tightly engaged with each other by the concave engagement portion functioning as a cam groove. Moreover, engagement projections 918 are prevented from being removed from engagement grooves 883. As a result, a secure engagement can be established and maintained between connectors 801, 901.

In the state illustrated in FIG. 28, engagement lever 881 is positioned at the initial position and in tight contact with initial position protrusive abutting portion 834*b* formed in one of side walls 824. When engagement lever 881 reaches the fitting completion position, engagement lever 881 comes in tight contact with fitting completion position protrusive abutting portion 834*a* formed in one of side walls 824.

However, in the above-described conventional connector, since engagement lever 881 is not locked at the fitting completion position, engagement lever 881 may return to the initial position upon being subjected to an unexpected external force, such as an impact force or a vibration. As a result, the engagement with plug-side connector 901 might not be maintained. In particular, when the connector is mounted on a vehicle, the connector may be subject to vibration consistent with the running of the vehicle. Therefore, it is highly likely that engagement lever 881 will return to the initial position.

SUMMARY OF THE INVENTION

Therefore, it is an object of the Present Invention to obviate the above-described problems encountered by the conventional connector, and to provide a connector which has good operability and high reliability. To this end, a lever, configured to be rotatable so as to engage an engagement member of a counterpart connector, is provided with a lock portion that is slidable relative to a body portion of the lever. The lever is further provided with a latching portion capable of being latched with the body portion at a lock position and a lock release position, so that the lever becomes unable to rotate by being locked at a fitting completion position. The lock portion is not slid from the lock position and thus is not unnecessarily unlocked. As a result, the engagement with the counterpart connector is not released upon reception of any unexpected external force. Further, an operator can perceive a sense of click-feeling when the lock portion is slid from either the lock position or the lock release position, and thus an erroneous operation of the lock portion can be prevented.

For this reason, a connector according to the Present Invention includes a housing which receives therein a plurality of terminals; a lever which is rotatably attached to the housing and is configured to be rotatable between a first position where an initial stage of fitting of the connector to a counterpart connector is established and a second position where the fitting to the counterpart connector is completely established; and a lock portion which is capable of locking the lever at the second position, wherein the lock portion is slidably attached to a body portion of the lever and is configured to be slid between a lock position where the lever is locked and a lock release position where the lock is released; the lever is provided with a positioning latch-portion that is configured to latch the lock portion at the lock position and the lock release position, respectively; and the positioning latch-portion is provided with a concaved latch-portion and a convexed latch-portion that is configured to be elastically displaced to be engaged in or disengaged from the concaved latch-portion.

In the connector according to another embodiment of the Present Invention, the lever is arranged to extend in a direction perpendicular to the direction of fitting to the counterpart connector at the second position.

In the connector according to a further embodiment of the Present Invention, the convexed latch-portion is formed at a free end of a cantilever-like elastic positioning arm portion having a proximal end thereof being connected to the body portion, and the concaved latch-portion is formed at the lock portion and includes a first positioning concaved latch-portion capable of being engaged with the convexed latch-portion to latch the lock portion at the lock position and a second positioning concaved latch-portion capable of being engaged with the convexed latch-portion to latch the lock portion at the lock release position.

In the connector according to a still further embodiment of the Present Invention, the lock portion includes an operation portion that is disposed at a rear end of the lever and is arranged to extend in a direction distant away from a rotation shaft of the lever, and a distance from the operation portion to the rotation shaft when the lock portion is positioned at the lock release position becomes longer than that when the lock portion is positioned at the lock position.

In the connector according to a still further embodiment of the Present Invention, the lock portion includes a latch-portion that is disposed at a rear end of the lever and is arranged to extend in a direction toward a rotation shaft of the lever, a distance from the latch-portion to the rotation shaft when the lock portion is positioned at the lock position becomes shorter than that when the lock portion is positioned at the lock release position, and when the lock portion is moved to the lock position in a state where the lever is positioned at the second position, the latch-portion is latched by coming into a lever-latching concave-portion formed in an outer circumference of the housing.

In accordance with the Present Invention, the cable includes a lever that is configured to be rotatable to thereby be engaged with an engagement member of a counterpart connector, a lock portion that is slidable relative to a body portion of the lever, and a latching portion capable of latching the lock portion at a lock position and a lock release position with respect to the body portion. Owing to this arrangement, the lever becomes unable to rotate by being locked at a fitting completion position, and the lock portion is not slid from the lock position and thus is not unnecessarily unlocked. Therefore, the engagement with the counterpart connector is not released upon being subjected to an unexpected external force such as an impact force or vibration. Furthermore, an operator can perceive a sense of click-feeling when the lock portion is slid from the lock position and the lock release position, and thus any erroneous operation on the lock portion can be prevented. Accordingly, it is possible to provide good operability and high reliability.

BRIEF DESCRIPTION OF THE FIGURES

The organization and manner of the structure and operation of the Present Invention, together with further objects and advantages thereof, may best be understood by reference to the following Detailed Description, taken in connection with the accompanying Figures, wherein like reference numerals identify like elements, and in which:

FIGS. 4A to 4C are three planar views of the cable-side connector according to an embodiment of the Present Invention, in which FIG. 4A is a front view, FIG. 4B is a bottom plan view, and FIG. 4C is a cross-sectional view taken along the arrows X-X in FIG. 4A;

FIGS. 5A to 5C are three planar views of the board-side connector according to an embodiment of the Present Invention, in which FIG. 5A is a bottom plan view, FIG. 5B is a front view, and FIG. 5C is a cross-sectional view taken along the arrows Y-Y in FIG. 5B;

FIGS. 15A to 15E are cross-sectional views of the lever of the cable-side connector according to an embodiment of the Present Invention, illustrating a state where the lever is positioned at the lock position, in which FIG. 15A is a front view, FIG. 15B is a cross-sectional view taken along the arrows P-P in FIG. 15A, FIG. 15C is an enlarged view of the "Q" portion in FIG. 15B, FIG. 15D is a cross-sectional view taken along the arrows R-R in FIG. 15A, and FIG. 15E is an enlarged view of the "S" portion in FIG. 15D;

FIGS. 16A to 16E are cross-sectional views of the lever of the cable-side connector according to an embodiment of the Present Invention, illustrating the state where the lever is positioned at the lock release position, in which FIG. 16A is a front view, FIG. 16B is a cross-sectional view taken along the arrows T-T in FIG. 16A, FIG. 16C is an enlarged view of the "U" portion in FIG. 16B, FIG. 16D is a cross-sectional view taken along the arrows V-V in FIG. 16A, and FIG. 16E is an enlarged view of the "W" portion in FIG. 16D;

FIGS. 17A to 17C are first views of six planar views of the lever of the cable-side connector according to an embodiment of the Present Invention, illustrating a state where the lever is positioned at the lock position, in which FIG. 17A is a front view, FIG. 17B is a top plan view, and FIG. 17C is a right side view;

FIGS. 18A to 18C are second views of six planar views of the lever of the cable-side connector according to an embodiment of the Present Invention, illustrating a state where the lever is positioned at the lock position, in which FIG. 18A is a bottom plan view, FIG. 18B is a left side view, and FIG. 18C is a rear view;

FIGS. 19A to 19C are first views of six planar views of the lever of the cable-side connector according to an embodiment of the Present Invention, illustrating the state where the lever is positioned at the lock release position, in which FIG. 19A is a front view, FIG. 19B is a top plan view, and FIG. 19C is a right side view;

FIGS. 20A to 20C are second views of six planar views of the lever of the cable-side connector according to an embodiment of the Present Invention, illustrating a state where the lever is positioned at the lock release position, in which FIG. 20A is a bottom plan view, FIG. 20B is a left side view, and FIG. 20C is a rear view;

DESCRIPTION OF THE PREFERRED EMBODIMENTS

Figure 1:
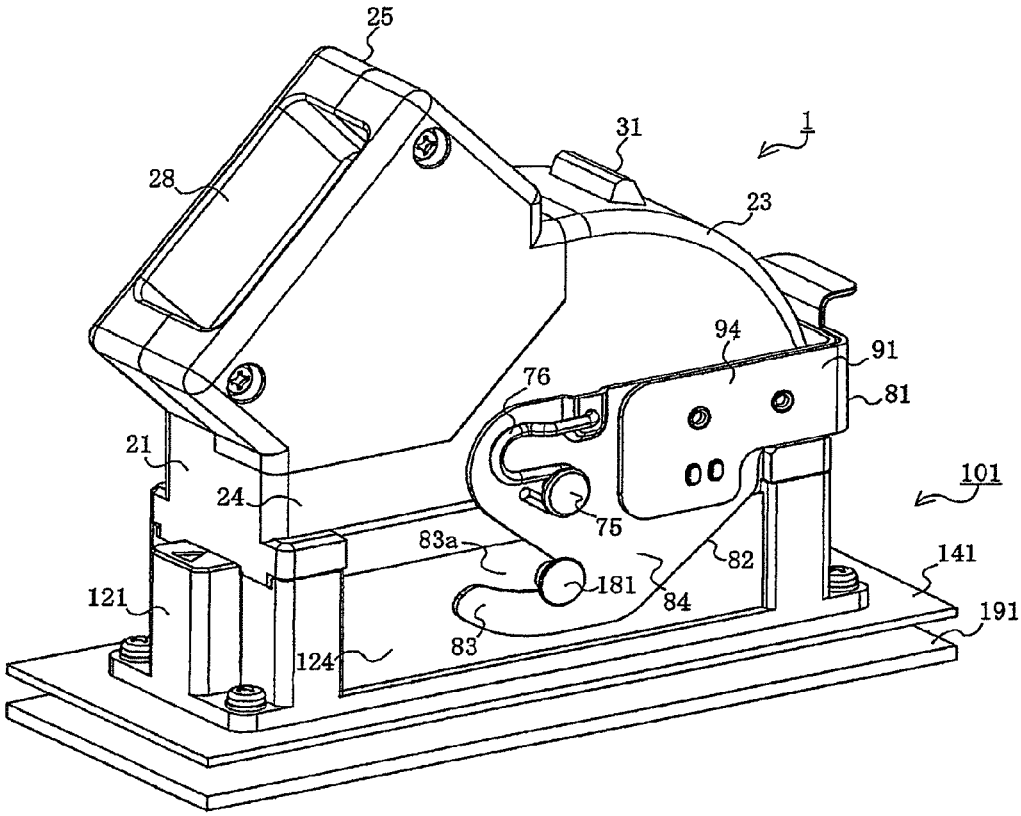
FIG. 1 is a perspective view of a cable-side connector according to an embodiment of the Present Invention, illustrating a state where the cable-side connector is tightly fitted to a board-side connector.

While the Present Invention may be susceptible to embodiment in different forms, there is shown in the Figures, and will be described herein in detail, specific embodiments, with the understanding that the disclosure is to be considered an exemplification of the principles of the Present Invention, and is not intended to limit the Present Invention to that as illustrated.

In the embodiments illustrated in the Figures, representations of directions such as up, down, left, right, front, rear and the like, used for explaining the structure and movement of the various elements of the Present Invention, are not absolute, but relative. These representations are appropriate when the elements are in the position shown in the Figures. If the description of the position of the elements changes, however, it is assumed that these representations are to be changed accordingly.

Referring to FIGS. 1-5, cable-side connector 1 (hereinafter referred to as a cable connector) is engaged by tight fitting to board-side connector 101 (hereinafter referred to as a board connector). Board connector 101 is mounted on panel member 141, which is a side wall of a casing for accommodating an electronic device, connected to board 191 arranged inside the casing. In the Figures, only portions of panel member 141 and board 191 are illustrated.

Board connector 101 includes plug housing 111 is integrally formed of an insulating material, plurality of plug terminals 161 fitted in plug housing 111, and enclosure 121, a protective member integrally formed of an insulating or highly rigid material and configured to cover a perimeter of plug housing 111. Enclosure 121 is coupled to plug housing 111 to thereby function as a part of a housing of board connector 101.

Plug housing 111 is preferably a box-like member having an elongated rectangular parallel-piped shape with an open top, and is provided with rectangular, thick plate-like bottom plate portion 112, side wall portions 114—formed of four plate-like members vertically connected to the sides of bottom plate portion 112, and pair of flange portions 115 outwardly extending from a pair of plate-like members of side wall portions 114 and corresponding to a pair of shorter sides of rectangular bottom plate portion 112. Concave fitting portion 113 has a perimeter defined by bottom plate portion 112 and side wall portions 114 while having an open upper surface. Receptacle housing 11 is fitted in concave fitting portion 113.

Preferably, plug terminals 161 are rod or pin-shaped members formed of a conductive material. A plurality of lines of plug terminals 161 is arranged in a grid pattern to be fitted in plug housing 111. It should be noted that the number and the arrangement pattern of plug terminals 161 are not limited to the illustrated example, but may be appropriately configured. Each plug terminal 161 is provided with tail portion 162—inserted into one of through holes 192 formed in board 191 and connected to a non-illustrated conductive trace formed in board 191, body portion 163—held on bottom plate portion 112 of plug housing 111, and contacting portion 164—which comes into contact with receptacle terminal 61 of cable connector 1. In FIGS. 1-5, tail portion 162 downwardly extends from a lower surface of bottom plate portion 112. Further, body portion 163 is held by being press-fit to a non-illustrated through hole formed in bottom plate portion 112. Furthermore, contacting portion 164 upwardly extends from an upper surface of bottom plate portion 112 to be arranged within concave fitting portion 113.

Preferably, enclosure 121 is a tube-like member having an elongated rectangular parallel-piped shape, provided with housing receiving hole 123 having a rectangular cross-sectional shape that is penetrated in the up-down direction. Enclosure 121 is provided with outer wall portions 124—formed of four plate-like members defining four surfaces of housing receiving hole 123, pair of flange portions 122—outwardly extending from a pair of plate-like members of outer wall portions 124 and corresponding a pair of shorter sides of the cross section of rectangular housing receiving hole 123, and pair of flange supporting portions 125 inwardly extending from the pair of plate-like members.

Another pair of plate-like members of outer wall portions 124, corresponding to a pair of longer sides of the cross section of rectangular housing receiving hole 123, is provided with lock pin 181 as an engagement member (lock pin 181 being attached to each of the plate-like members). Lock pin 181 is preferably a rivet-like member formed of an insulating or highly rigid material. Lock pin 181 preferably has circular column-shaped body portion 181*a*, around which cylindrical sleeve 182 is rotatably attached (cylindrical sleeve 182 also being formed of an insulating or highly rigid material).

Figure 3:
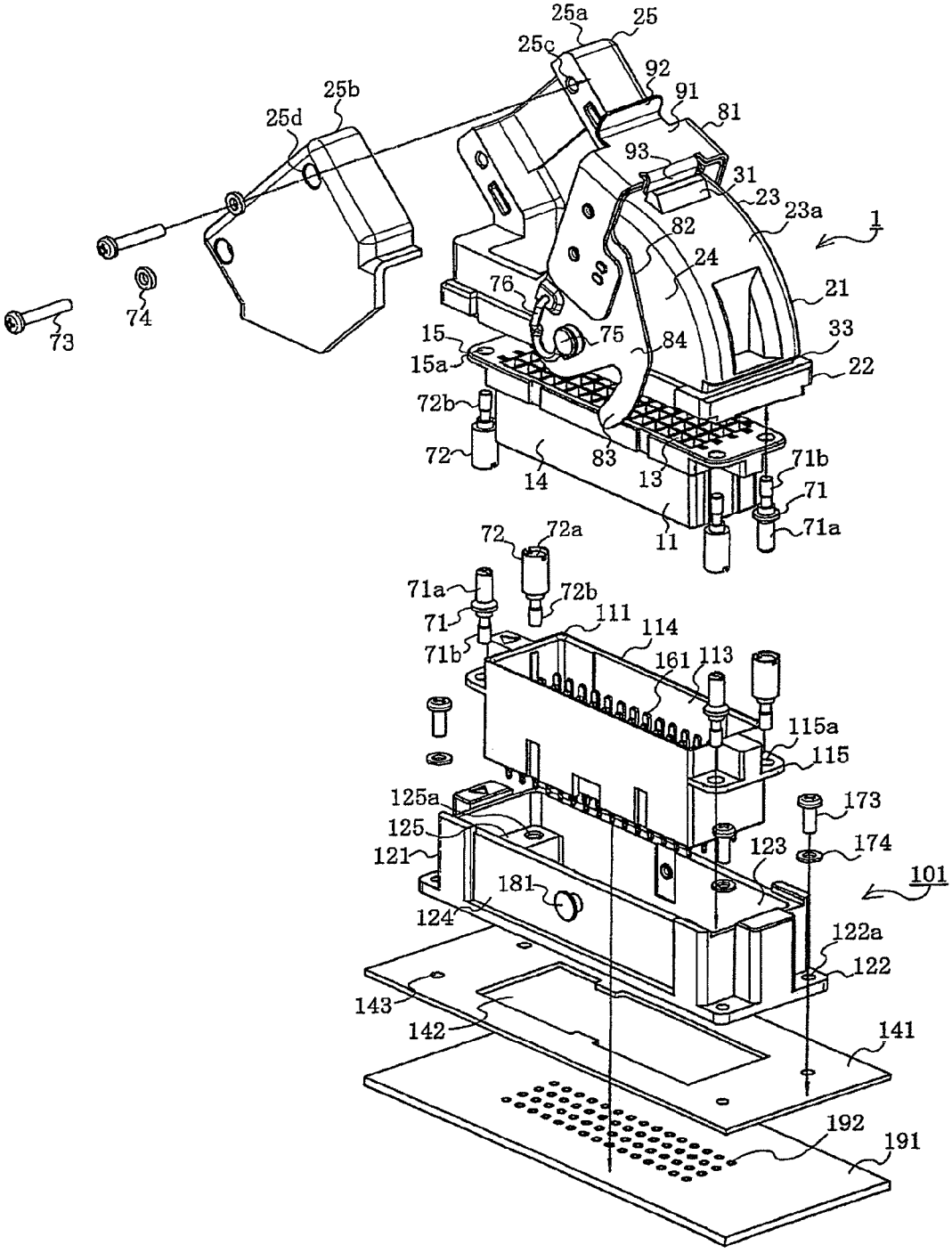
FIG. 3 is an exploded view of the cable-side connector and the board-side connector according to an embodiment of the Present Invention.

As illustrated in FIG. 3, plug housing 111 is inserted into housing receiving hole 123 from an upper side of enclosure 121 so that flange portions 115 of plug housing 111 are supported by flange supporting portions 125 from a lower side thereof. Moreover, flange portions 115 and flange supporting portions 125 are coupled to each other by means of guide pins 71 and guide bushes 72 (which together act as a connector guide member).

Guide pin 71 and guide bush 72 are preferably formed of an insulating or highly rigid material, and are provided with downwardly protrusive insertion portions 71*b* and 72*b*, respectively. When insertion portions 71*b* and 72*b* are inserted via through holes 115*a*, formed in flange portions 115, into insertion holes 125*a* formed in flange supporting portions 125 (in this case, the "insertion" may be carried out by "press-fitting" or "threading"), flange portions 115 and flange supporting portions 125 are fixedly coupled to each other. Further, an upper portion of guide pin 71 is configured as circular column-shaped guide portion 71*a* so that it can be inserted in guide hole 72*a* (formed in a cylindrical upper portion of guide bush 72). Owing to this arrangement, it is possible to obtain board connector 101 in which the perimeter of plug housing 111 is defined by enclosure 121.

Enclosure 121 is fixed to panel member 141, and tail portions 162 of plug terminals 161 are inserted into through holes 192 of board 191. In this case, portions of plug housing 111 projecting downwardly from a lower end of enclosure 121 are inserted within connector receiving hole 142 formed in panel member 141. Further, tail portions 162 are preferably bonded to through holes 192 by means of a conductive bonding material. Moreover, enclosure 121 is fixed by threading flange portions 122 into panel member 141 by means of screws 173. Flange portions 122 have through holes 122*a* formed therein, and panel member 141 has screw holes 143 formed therein. Therefore, screws 173 can be threaded into screw holes 143 via through holes 122*a*. In this case, it is preferable that washer 174 be disposed between a head part of each of screws 173 and each flange portion 122.

Figure 4A:
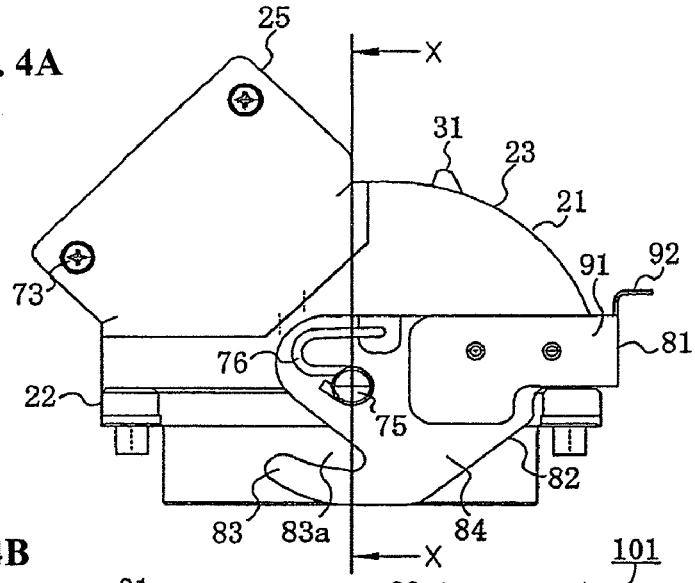
Figure 4B:
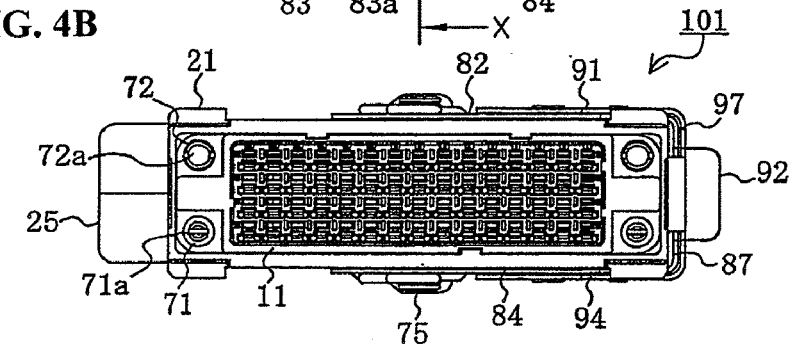
Figure 4C:
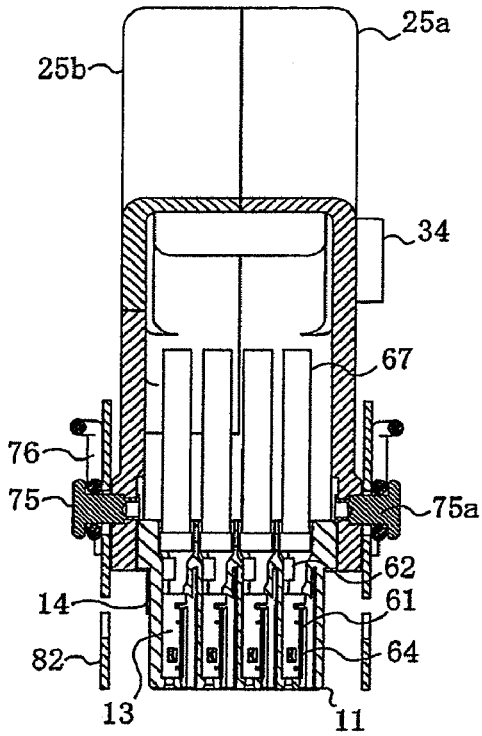
Figure 5A:
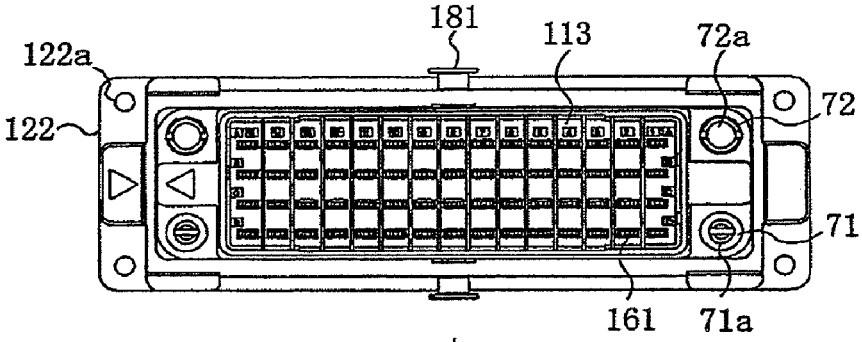
Figure 5B:
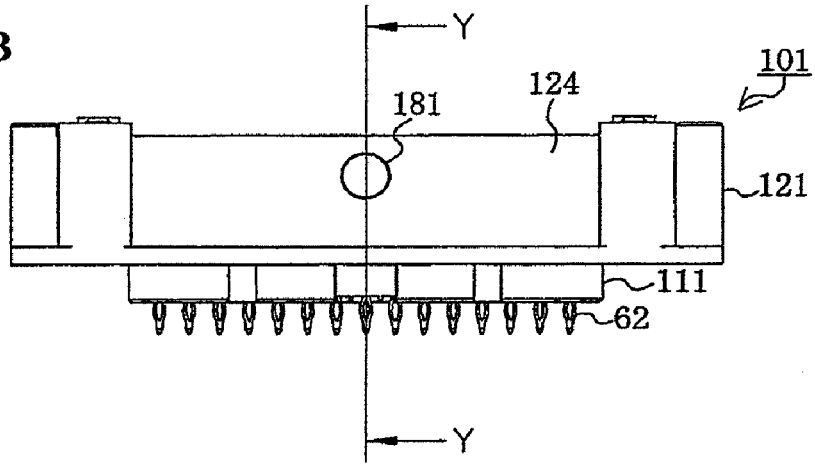
Figure 5C:
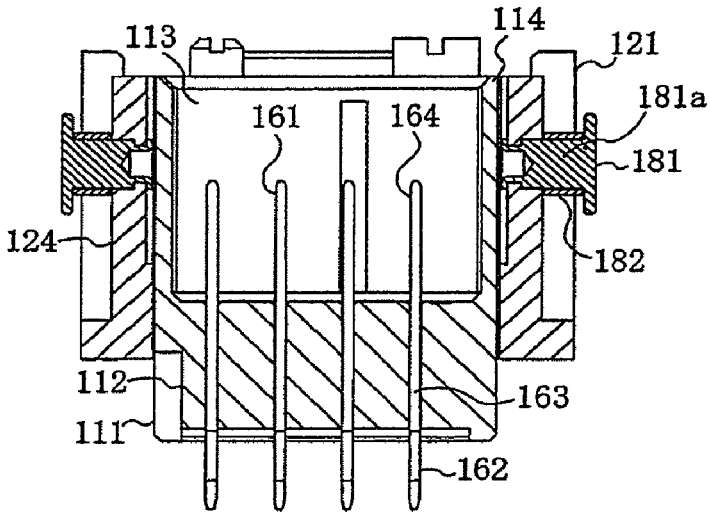

In the present embodiment, although cable connector 1 is a connector that is connected to an extreme end of a conductive cable formed of plurality of conductive wires 67, the conductive cable is not illustrated, and only a portion of the extreme end of conductive wires 67 is illustrated in FIG. 4C, while an illustration of other portions thereof is omitted.

As illustrated in detail in FIGS. 3 and 4, cable connector 1 includes receptacle housing 11 integrally formed of an insulating material, plurality of receptacle terminals 61 fitted in receptacle housing 11, and hood 21 integrally formed of an insulating or highly rigid material and configured to cover an upper portion of receptacle housing 11. Hood 21 is coupled to receptacle housing 11, thereby functioning as a part of a housing of cable connector 1.

Preferably, receptacle housing 11 is a box-like member having an elongated rectangular parallel-piped shape and provided with plurality of elongated terminal receiving holes 13, four side wall portions 14 (both extending in the up-down direction), and pair of flange portions 15 outwardly extending from a pair of plate-like members of side wall portions 14 corresponding to a pair of shorter sides of the rectangular cross section of the box-like member.

Preferably, each receptacle terminal 61 is an elongated member formed of a conductive material and fitted to respective terminal receiving hole 13. It is to be noted that the number and the arrangement pattern of receptacle terminals 61 are configured so as to correspond to the number and the arrangement pattern of plug terminals 161 of board connector 101. Consequently, the number and arrangement pattern of terminal receiving holes 13 are also configured so as to correspond to the number and the arrangement pattern of plug terminals 161 of board connector 101. In the example illustrated in the Figures, since plug terminals 161 are arranged in a grid pattern, terminal receiving holes 13 are also arranged in a grid pattern or a honeycomb pattern so that receptacle housing 11 is subdivided. It should also be noted that receptacle terminals 61 do not necessarily have to be fitted in all terminal receiving holes 13.

Further, each receptacle terminal 61 is provided with tail portion 62, connected to an extreme end of each conductive wire 67, and contacting portion 64, which comes into contact with plug terminal 161. Since tail portion 62 is positioned within one of terminal receiving holes 13, each of conductive wires 67 is connected to tail portion 62 while having its extreme end entering into one of terminal receiving holes 13 from an upper side thereof. Moreover, since contacting portion 64 is positioned within one of terminal receiving holes 13 when connectors 1, 101 are engaged, by tight fitting, to each other, contacting portion 164 of each of plug terminals 161 comes into contact with contacting portion 64 while having an upper end thereof entering into one of terminal receiving holes 13 from a lower side thereof.

Figure 2:
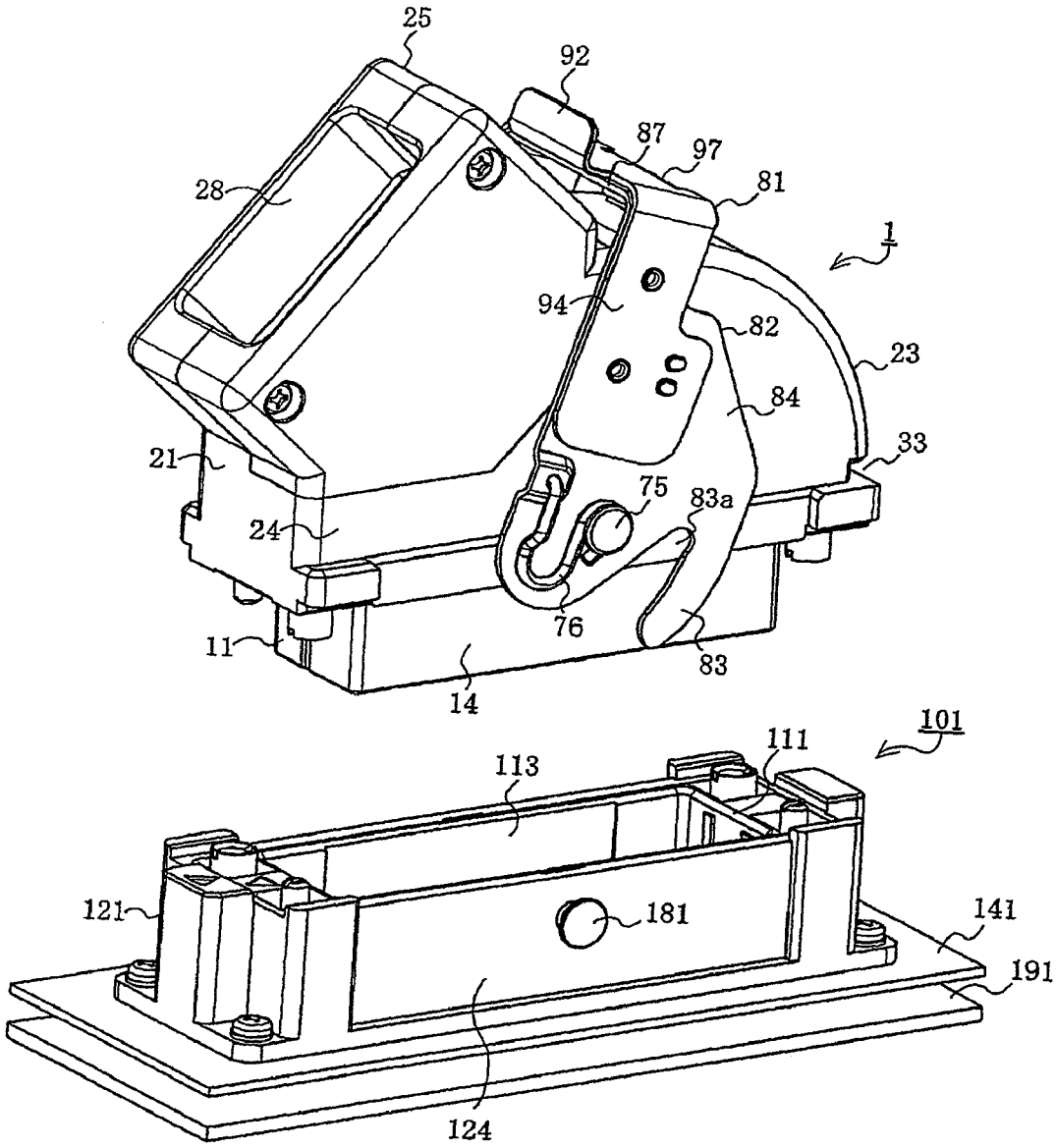
FIG. 2 is a perspective view of the cable-side connector according to an embodiment of the Present Invention, illustrating the state where the cable-side connector is not yet tightly fitted to the board-side connector.

Preferably, hood 21 is provided with bottom portion 22 having a generally rectangular opening which receives therein an upper end of receptacle housing 11; dome portion 23 having a sector form with a center angle of Ninety Degrees (90°) (best viewed from the front in FIG. 4A); dome portion 23 being connected to an upper end of bottom portion 22; and cable lead-out portion 25 having a tilted rectangular shape (best viewed from the front in FIG. 4A), cable lead-out portion 25 being connected to an upper end of bottom portion 22. The interior of receptacle housing 11 is a hollow space communicating with an opening of bottom portion 22 opened to a lower surface thereof. As illustrated in FIGS. 1-2, the hollow space also communicates with cable lead-out opening 28 of cable lead-out portion 25 obliquely opened upwardly. The extreme end of a non-illustrated cable is inserted into the hollow space within receptacle housing 11 through cable lead-out opening 28 from an obliquely upper side thereof. Moreover, extreme ends of conductive wires 67 exposed from the extreme end of the cable are connected to tail portions 62 to be inserted into terminal receiving holes 13, as best illustrated in FIG. 4C.

In the example illustrated in the Figures, cable lead-out portion 25 is provided with integral portion 25*a*, integrally formed with other portions of hood 21 and separate portion 25*b* that is removably attached to integral portion 25*a*. In this case, separate portion 25*b* is attached into integral portion 25*a* by means of screws 73. Separate portion 25*b* has through holes 25*d* formed therein, and integral portion 25*a* has screw holes 25*c* formed therein. Therefore, screws 73 can be threaded into screw holes 25*c* via through holes 25*d*. It is preferable that washer 74 is disposed between a head part of each of screws 73 and separate portion 25*b*.

Further, lever lock pin 75 is attached to each of outer wall portions 24 on front and rear surfaces of hood 21. Preferably, lever lock pin 75 is a rivet-like member formed of an insulating or highly rigid material. Lever lock pin 75 has circular column-shaped body portion 75*a* around which lever 81 is attached. Further, portions of outer wall portions 24, to which lever lock pin 75 is attached, are approximately at the center in the longitudinal direction (the horizontal direction in FIG. 4A) of bottom portion 22, and correspond to boundary portions between bottom portion 22 and dome portion 23. Furthermore, the central point of the sector form, which is the front shape of dome portion 23, does not correspond to the attachment portion of lever lock pin 75, but is located at a position shifted rightward in FIG. 4A from the attachment portion.

Lever 81 is provided with body portion 82, with lock portion 91 slidably attached. Body portion 82 preferably is integrally formed of an insulating or highly rigid material, and generally has a "U" shape or an arch-like shape, as viewed from an upper or lower side thereof in FIG. 4B. A portion corresponding to the vertex of the arch is connection portion 87, and leg parts 84 are connected to both ends (upper and lower ends in FIG. 4B) of connection portion 87 so as to extend toward lever lock pin 75. Further, body portion 82 has a linearly symmetrical shape with respect to a central axis thereof that extends in the longitudinal direction (the horizontal direction in FIG. 4B) of the lower surface of the cable connector 1. That is, body portion 82 has an identical shape in both front and rear views. Moreover, body portion 82 is rotatably attached to hood 21 so as to extend over the outer sides of dome portion 23.

Similarly, lock portion 91 is preferably integrally formed of an insulating or highly rigid material, and generally has a "U" shape or an arch-like shape, as viewed from an upper or lower side thereof in FIG. 4B. A portion corresponding to the vertex of the arch is connection portion 97, and leg parts 94 are connected to both ends (upper and lower ends in FIG. 4B) of connection portion 97 so as to extend toward lever lock pin 75. Further, lock portion 91 has a linearly symmetrical shape with respect to a central axis thereof that extends in the longitudinal direction of the lower surface of cable connector 1. That is, lock portion 91 has an identical shape in both front and rear views. Moreover, lock portion 91 is attached to body portion 82 so as to overlap with the outer sides of body portion 82.

At portions in the vicinity of leg parts 84, later-described pin insertion holes 84*a* are formed, so that body portions 75*a* of lever lock pins 75 are inserted through pin insertion holes 84*a*. Therefore, lever 81 is rotated about lever lock pins 75. Moreover, in portions of leg parts 84 lower than pin insertion holes 84*a*, engagement arm portions 83 and concave engagement portions 83*a* are formed so as to be engaged with lock pins 181 of board connector 101. As illustrated in FIG. 1, when lever 81 is moved to a fitting completion position in a state where cable connector 1 and board connector 101 are engaged, by tight fitting, to each other, lock pins 181 enter into concave engagement portions 83*a* so that they are also engaged to each other.

Further, as illustrated in FIG. 1, lever 81 is upwardly urged by lever spring 76 when positioned at the fitting completion position. Lever spring 76 is a rod member formed of an elastic material, capable of bending in a curved shape. Lever spring 76 has one end rotatably attached to each of body portions 75*a*, and another end, engaged with each of leg parts 84.

Dome portion 23 has rear surface portion 23*a*, which is a curved surface similar to the side surface of a cylinder. The center of curvature of rear surface portion 23*a* is the central point of the sector form, which is the front shape of dome portion 23, and is located at a position shifted rightward in FIG. 4A from the attachment portion of outer wall portions 24, to which lever lock pin 75 is attached. Further, a distance of rear surface portion 23*a* measured from lever lock pin 75 is preferably shorter than a radius of rotation of connection portion 87; that is, shorter than a distance between connection portion 87 and lever lock pin 75. Moreover, body portion 82 can be rotated without interfering with rear surface portion 23*a*. Furthermore, protrusive initial position latching portion 31 is formed in rear surface portion 23*a*. However, body portion 82 does not interfere with initial position latching portion 31. Furthermore, groove-shaped fitting completion position latching portion 33, recessed toward lever lock pin 75, is formed at the boundary portion of the rear surface portion 23*a* and bottom portion 22. However, body portion 82 does not interfere with fitting completion position latching portion 33.

Moreover, initial position protrusive abutting portion 34 is formed on a rear surface of hood 21 corresponding to the boundary portion of dome portion 23 of outer wall portion 24 and cable lead-out portion 25. When initial position protrusive abutting portion 34 comes into tight contact with leg part 84 of body portion 82 disposed close to the rear surface of hood 21, lever 81 is regulated at the initial position as a first position. That is, when lever 81 is rotated to reach the initial position illustrated in FIGS. 2-3, leg part 84 of body portion 82, disposed close to the rear surface of hood 21, comes into tight contact with initial position protrusive abutting portion 34. As a result, lever 81 might not be further rotated in the counter-clockwise direction in FIG. 2. In addition, leg part 94 disposed close to the rear surface of hood 21 also comes into tight contact with initial position protrusive abutting portion 34 together with leg part 84.

Bottom portion 22 has both ends projecting in the longitudinal (width) direction; that is, both ends project in the forward and backward directions in relation to hood 21. Therefore, when leg parts 84 come into tight contact with bottom portion 22, lever 81 is regulated at the fitting completion position as a second position. That is, when lever 81 is rotated to reach the fitting completion position as illustrated in FIGS. 1 and 4, leg parts 84 come into tight contact with the upper surface of bottom portion 22. As a result, lever 81 might not be further rotated in the clockwise direction, illustrated in FIGS. 1 and 4. In addition, leg parts 94 also come into tight contact with the upper surface of bottom portion 22, together with leg parts 84.

Lock portion 91 is provided with operation portion 92 connected to an upper end of connection portion 97, and latching portion 93 connected to a lower end of connection portion 97. Operation portion 92 is preferably a plate-like portion that is disposed at a rear end of lever 81 so as to extend in a direction approximately perpendicular to connection portion 97 and opposite to the arrangement direction of leg part 94; that is, in a direction away from lever lock pin 75. Operation portion 92 may be operated by an operator in order to rotate lever 81.

Preferably, latching portion 93 is a plate-like portion that extends in a direction approximately perpendicular to connection portion 97, and in the same direction as the arrangement direction of leg part 94; that is, in a direction toward lever lock pin 75. When lock portion 91 is positioned at a later-described lock release position relative to body portion 82, the distance from latching portion 93 to lever lock pin 75 becomes longer. Therefore, even when lever 81 is rotated, lock portion 91 including latching portion 93 does not interfere with rear surface portion 23*a*. On the other hand, as illustrated in FIGS. 1-4, when lock portion 91 is positioned at a lock position relative to body portion 82, the distance from latching portion 93 to lever lock pin 75 decreases. Therefore, when lock portion 91 is slid relative to body portion 82 to be positioned at the lock position when lever 81 is at the initial position as illustrated in FIGS. 2-3, latching portion 93 is latched by interfering with an upper surface of protrusive initial position latching portion 31, as illustrated in FIG. 3. As a result, lever 81 is locked at hood 21 at the initial position and becomes unable to rotate. On the other hand, when lock portion 91 is slid relative to body portion 82 to be positioned at the lock position when lever 81 is at the fitting completion position, as illustrated in FIGS. 1 and 4, latching portion 93 is latched by coming into groove-shaped fitting completion position latching portion 33. As a result, lever 81 is locked at hood 21 at the fitting completion position, and becomes unable to rotate.

Moreover, when lever 81 is positioned at the fitting completion position, lever 81 and operation portion 92 are in a state where they extend in a direction perpendicular to the fitting direction (the up-down direction in FIGS. 1-2) with board connector 101. For this reason, the operator can easily apply a force, thus easily operating lever 81.

Hood 21 is attached to an upper end of receptacle housing 11. In this case, the upper end of receptacle housing 11, including flange portions 15, is inserted from a lower side to be received in an opening of bottom portion 22 of hood 21. Moreover, flange portions 15 and bottom portion 22 are coupled to each other by means of guide pins 71 and guide bushes 72. Specifically, insertion portions 71*b*, 72*b* of guide pins 71 and guide bushes 72 are inserted into non-illustrated insertion holes formed in bottom portion 22 via through holes 15*a* formed in flange portions 15, so that flange portions 15 and bottom portion 22 are coupled to each other. With this arrangement, illustrated in FIG. 4, it is possible to obtain cable connector 1 in which the upper portion of receptacle housing 11 is covered by hood 21.

Receptacle housing 11 protrudes downwardly from the lower surface of hood 21 and is inserted in concave fitting portion 113 of plug housing 111, in a state where cable connector 1 and board connector 101 is engaged, by tight fitting, to each other, as illustrated in FIG. 1.

Figure 6:
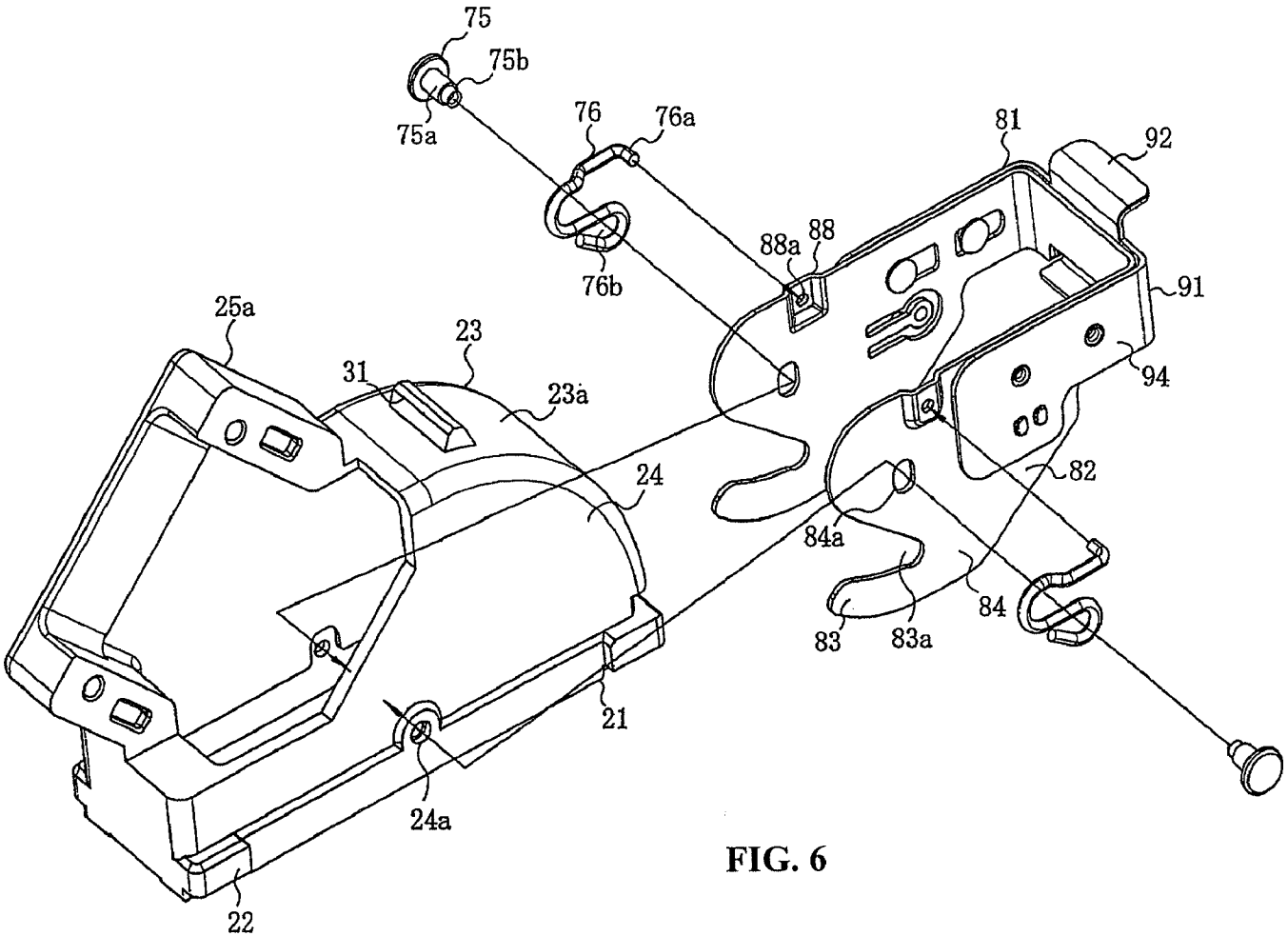
FIG. 6 is an exploded view of a hood of the cable-side connector according to an embodiment of the Present Invention.
Figure 7:
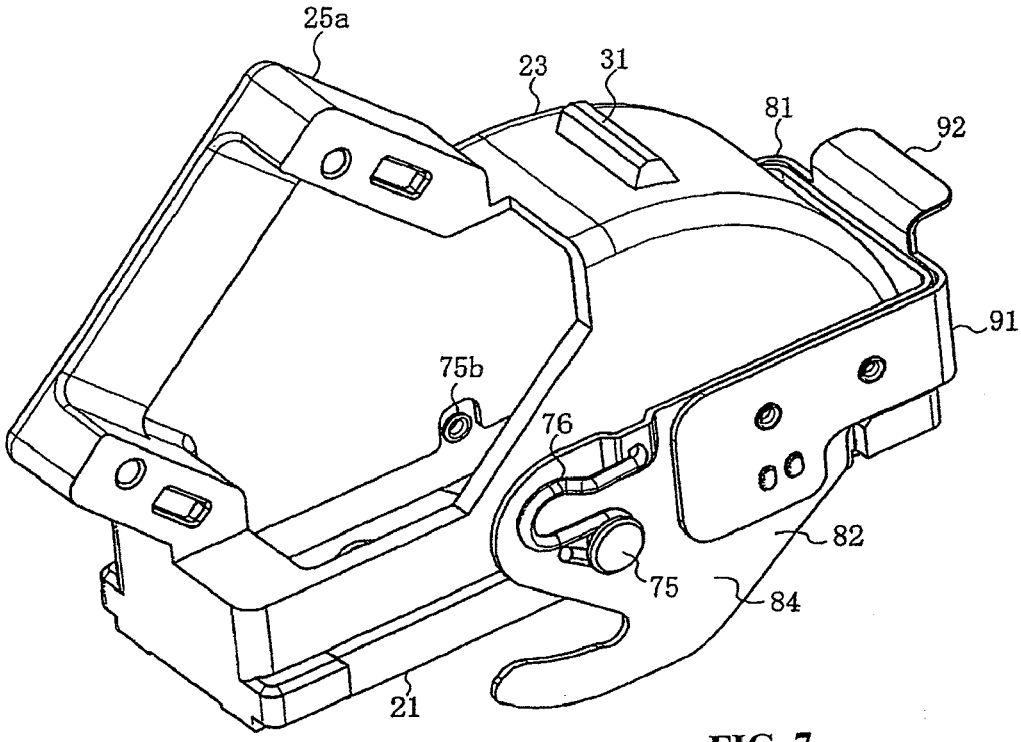
FIG. 7 is a perspective view of the hood of the cable-side connector according to an embodiment of the Present Invention, illustrating a state where a lever is positioned at a fitting completion position.
Figure 8:
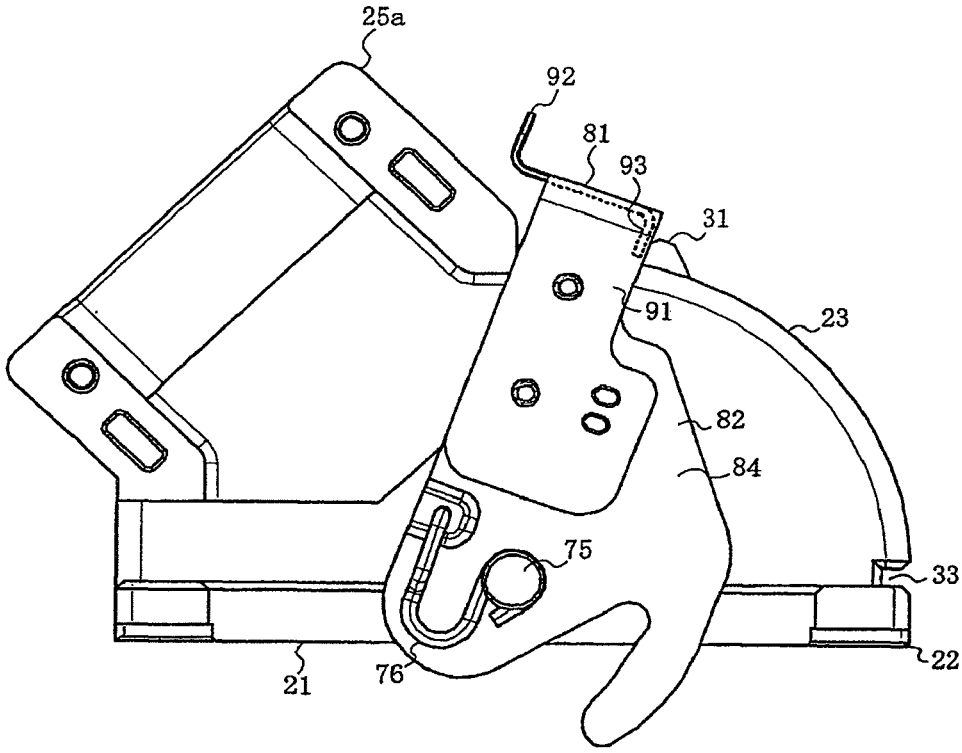
FIG. 8 is a front view of the hood of the cable-side connector according to an embodiment of the Present Invention, illustrating a state where the lever is positioned at an initial position.

Referring to FIGS. 6-11, a detailed description of an attachment structure of lever 81 to hood 21 and an attachment structure of lock pin 181 to enclosure 121 will be disclosed. FIGS. 6-8 illustrate a state where separate portion 25*b* of cable lead-out portion 25 is removed. In each of outer wall portions 24 on front and rear surfaces of hood 21, pin attachment through hole 24*a*, for attachment of lever lock pin 75, is formed so as to penetrate through each of outer wall portions 24. Moreover, portions of outer wall portions 24 corresponding to pin attachment through hole 24*a* are approximately at the center in the longitudinal direction (the horizontal direction in FIG. 8) of bottom portion 22 and correspond to boundary portions between bottom portion 22 and dome portion 23. Furthermore, the central point of the sector form, which is the front shape of dome portion 23, does not correspond to the portion of pin attachment through hole 24*a*, but is located at a position shifted rightward in FIG. 8 from the portion.

At portions in the vicinity of leg parts 84 on the front and rear surface sides of body portion 82, pin insertion holes 84*a* are formed to penetrate through corresponding ones of leg parts 84 so that lever lock pins 75 are inserted through pin insertion holes 84*a*. In this embodiment, the shape of pin insertion hole 84*a* is not circular but rather a vertically long ellipsoid or an oval shape. With this arrangement, lever 81 can be vertically displaced relative to lever lock pin 75 when lever 81 is positioned at the fitting completion position.

Further, in leg parts 84 on the front and rear surface sides of body portion 82 of lever 81, bulging portions 88 are formed so as to bulge outward, i.e., in a direction away from outer wall portions 24 of hood 21, and spring engagement holes 88*a* are formed so as to penetrate through bulging portions 88.

Lever spring 76 is a rod member formed of an elastic material and capable of bending in an approximately "U" shape. Moreover, the upper end of lever spring 76 is capable of bending at about right angles toward outer wall portions 24 and has formed therein engagement shaft 76*a*, inserted to be engaged with spring engagement hole 88*a*. On the other hand, the lower end of lever spring 76 is capable of bending in a loop shape and has formed therein pin opening 76*b*, through which body portion 75*a* of lever lock pin 75 is rotatably inserted.

Lever lock pin 75 is preferably a semi-tubular rivet-shaped member, for example, in which circular caulking portion 75*b* is formed at a distal end of circular column-shaped body portion 75*a* extending from an umbrella-shaped head part. When lever 81 is attached to hood 21, body portions 75*a* of lever lock pins 75 are inserted into pin openings 76*b* of lever springs 76 and pin insertion holes 84*a* of leg parts 84. Moreover, caulking portions 75*b* at the distal ends of body portions 75*a* are inserted into the pin attachment through holes 24*a* of outer wall portions 24. Furthermore, engagement shafts 76*a* of lever springs 76 are engaged with spring engagement holes 88*a* of leg parts 84. In addition, as illustrated in FIG. 7, a caulking processing is performed, from the inside of hood 21, to caulking portions 75*b* inserted into pin attachment through holes 24*a* of outer wall portions 24 from outside of the hood 21, so that caulking portions 75*b* are plastically deformed to be enlarged in a diameter thereof and finally fixed to outer wall portions 24. With this operation, lever 81 is rotatably attached to hood 21.

In the state illustrated in FIG. 7, lever 81 is positioned at the fitting completion position, and lock portion 91 is positioned at the lock position. Therefore, latching portion 93 is latched by coming into groove-shaped fitting completion position latching portion 33. Thus, lever 81 is unable to rotate by being locked at hood 21 at the fitting completion position. Moreover, lever spring 76 is in a state where a gap between engagement shaft 76*a* and pin opening 76*b* can be reduced more than that at the initial state. For this reason, lever spring 76 can function as a compression spring to apply an urging force that broadens a distance between pin insertion hole 84*a* and lever lock pin 75 so that lever 81 is upwardly urged with respect to lever lock pin 75.

Figure 9:
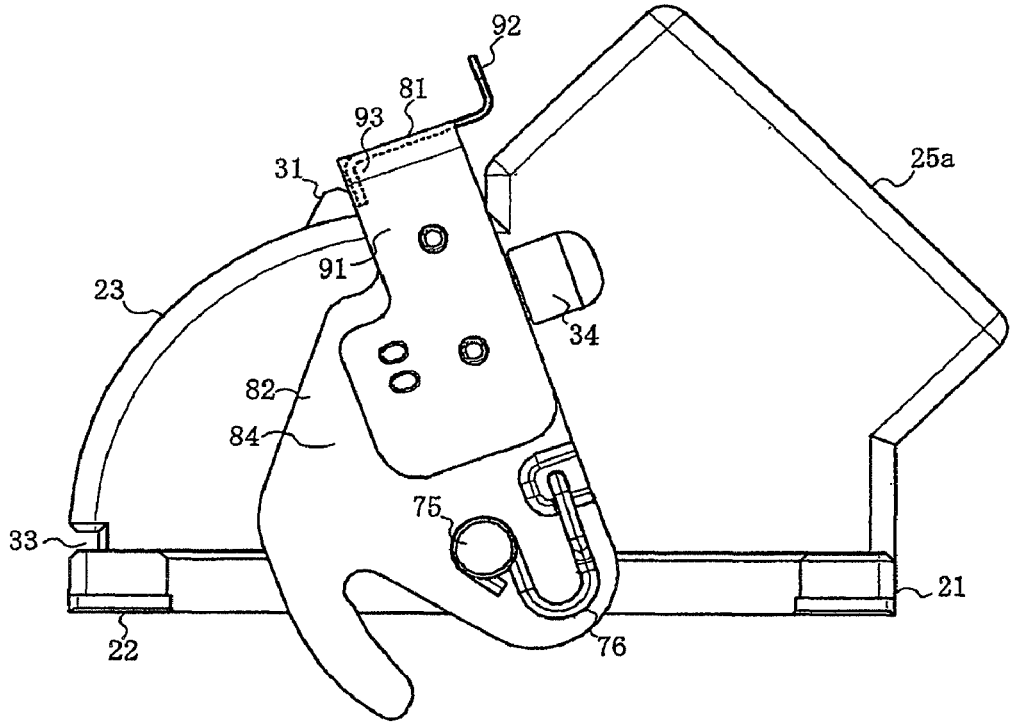
FIG. 9 is a rear view of the hood of the cable-side connector according to an embodiment of the Present Invention, illustrating a state where the lever is positioned at the initial position thereof.
Figure 10:
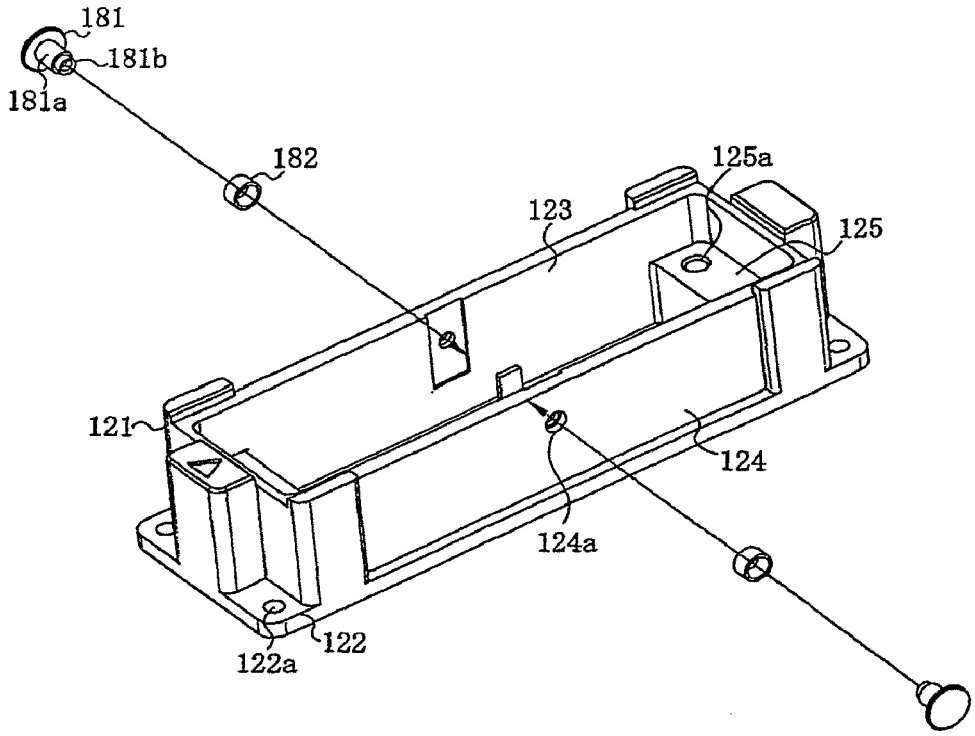
FIG. 10 is an exploded view of an enclosure of the board-side connector according to an embodiment of the Present Invention.

In the states illustrated in FIGS. 8-9, lever 81 is positioned at the initial position, and lock portion 91 is positioned at the lock position. Therefore, latching portion 93 of lock portion 91 is latched at protrusive initial position latching portion 31. Thus, lever 81 is unable to rotate by being locked at hood 21 at the initial position. On the other hand, in each of outer wall portions 124 on front and rear surfaces of enclosure 121, as illustrated in FIG. 10, pin attachment through hole 124*a* for attachment of lock pin 181 is formed so as to penetrate through each of outer wall portions 124. Moreover, portions of outer wall portions 124 corresponding to pin attachment through hole 124*a* are approximately at the center in the longitudinal direction of enclosure 121.

Figure 11:
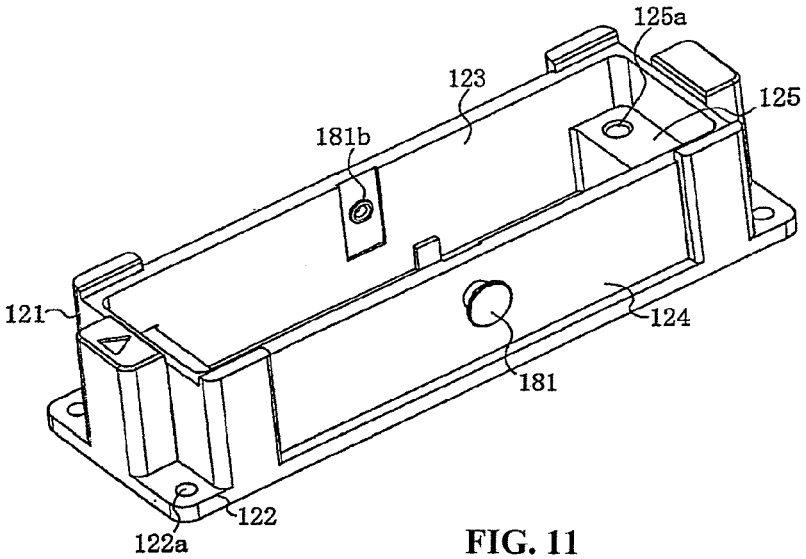
FIG. 11 is a perspective view of the enclosure of the board-side connector according to an embodiment of the Present Invention.
Figure 12:
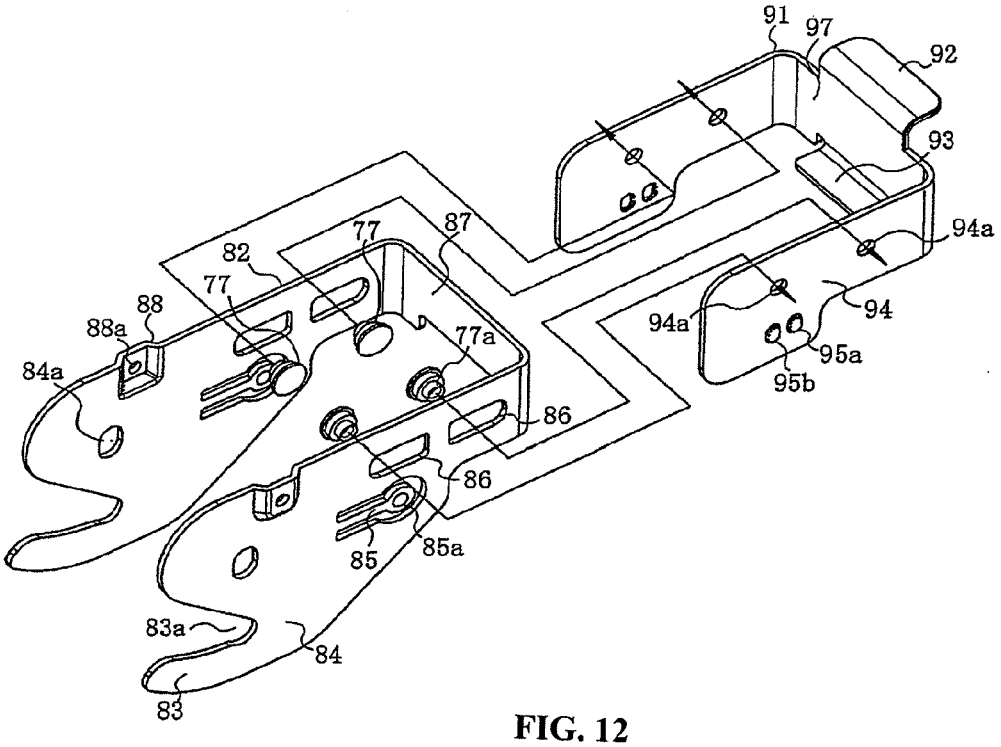
FIG. 12 is an exploded view of a lever of the cable-side connector according to an embodiment of the Present Invention.
Figure 13:
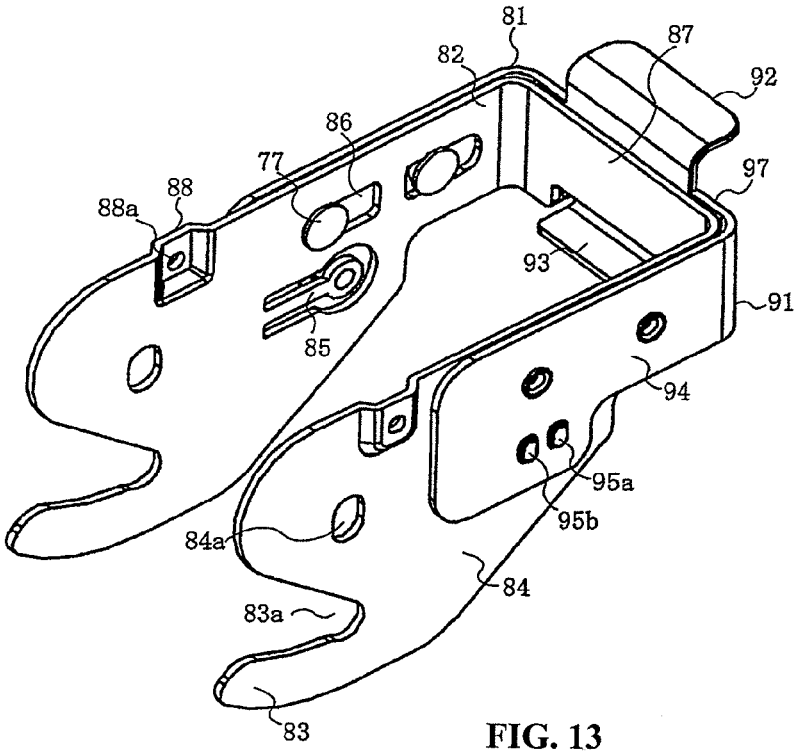
FIG. 13 is a perspective view of the lever of the cable-side connector according to an embodiment of the Present Invention, illustrating a state where the lever is positioned at a lock position thereof.

Lock pin 181 is a semi-tubular rivet-shaped member, for example, in which circular caulking portion 181*b* is formed at a distal end of circular column-shaped body portion 181*a* extending from an umbrella-shaped head part. When lock pin 181 is attached to enclosure 121, body portions 181*a* are inserted into sleeve 182. Moreover, caulking portions 181*b* at the distal ends of body portions 181*a* are inserted into pin attachment through holes 124*a* of outer wall portions 124. In addition, as illustrated in FIG. 11, a caulking processing is performed, from the inside of enclosure 121, to caulking portions 181*b* inserted into pin attachment through holes 124*a* of outer wall portions 124 from the outside of enclosure 121, so that caulking portions 181*b* are plastically deformed to be enlarged in a diameter thereof and finally fixed to outer wall portions 124. With this operation, lock pin 181 is attached to enclosure 121.

With reference to FIGS. 12-20, a detailed description of an attachment structure of lever 81 to body portion 82 will be described. As described above, in each of leg parts 84 on the front and rear surface sides of body portion 82 of lever 81, pin insertion hole 84*a* and bulging portion 88 are formed. Moreover, positioning arm portion 85, for latching lock portion 91 at the lock or lock release positions, is formed. Positioning arm portion 85 is preferably a cantilever-like elastic member having a proximal end thereof being connected to leg part 84, and a free end being capable of being elastically displaced in the thickness direction of leg part 84. At the free end of positioning arm portion 85, positioning convexed latch-portion 85*a* formed so as to bulge outwardly, i.e., in a direction away from outer wall portions 24 of hood 21.

In each of leg parts 84, two guide holes 86 are formed for guiding lock portion 91 that is slid relative to body portion 82. Guide holes 86 are elongated holes that extend in the sliding direction of lock portion 91, i.e., along a line connecting pin insertion hole 84*a* and connection portion 87 with each other so as to penetrate through leg parts 84, and guide holes 86 are arranged in parallel with each other. Further, body portion 77*a* of slide pin 77 is slidably inserted through each guide hole 86.

Further, in each leg part 94 on the front and rear surface sides of lock portion 91, first positioning concaved latch-portion 95*a* and second positioning concaved latch-portion 95*b*, for latching lock portion 91 at the lock or lock release positions, are formed. First positioning concaved latch-portion 95*a* is formed at a position closer to connection portion 97 than second positioning concaved latch-portion 95*b*. First positioning concaved latch-portion 95*a* engages with positioning convexed latch-portion 85*a* of body portion 82, so that lock portion 91 is latched at the lock position with respect to body portion 82. Second positioning concaved latch-portion 95*b* engages with positioning convexed latch-portion 85*a* of body portion 82, so that lock portion 91 is latched at the lock release position with respect to body portion 82. In this case, since positioning convexed latch-portion 85 is elastically deformed to be engaged with or disengaged from first and second positioning concaved latch-portions 95*a*, 95*b*, an operator operating lock portion 91 may be able to perceive a sense of click-feeling.

Further, in each leg part 94, two pin attachment holes 94*a* are formed so that slide pins 77 may be inserted to be fixed thereto. Each slide pin 77 is preferably a semi-tubular or tubular rivet-shaped member, for example, in which circular caulking portion 77*b* is formed at a distal end of circular column-shaped body portion 77*a* extending from an umbrella-shaped head part. Body portion 77*a* has a diameter smaller than a width of guide hole 86, and is configured to be capable of sliding along guide hole 86 in a state where it is inserted through guide hole 86.

Figure 15A:
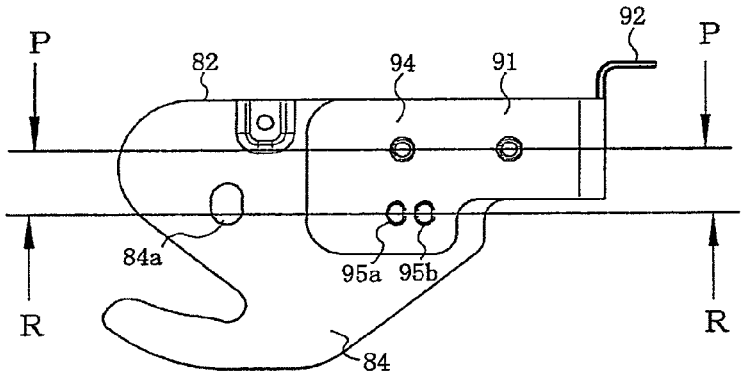
Figure 15B:
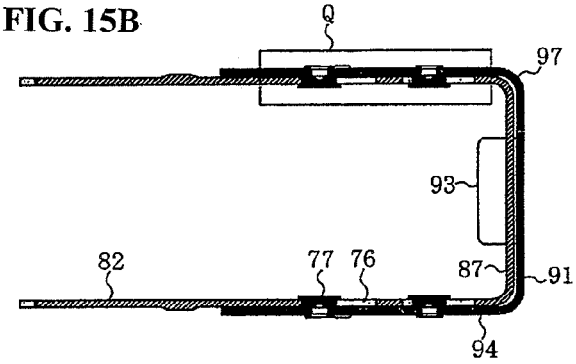
Figure 15C:
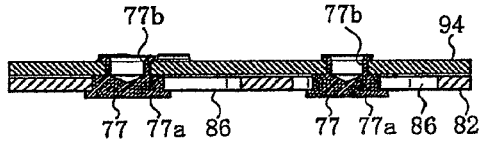
Figure 15D:
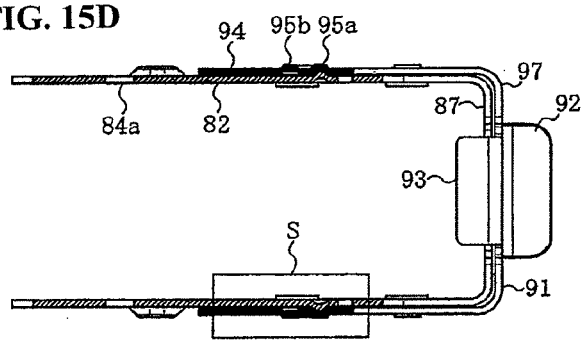
Figure 16A:
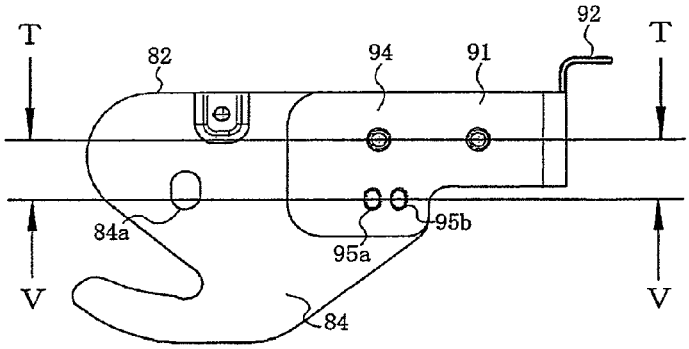
Figure 16B:
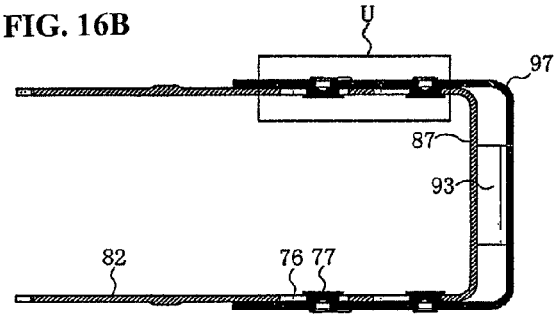
Figure 16C:
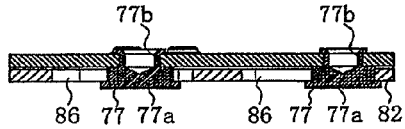
Figure 16D:
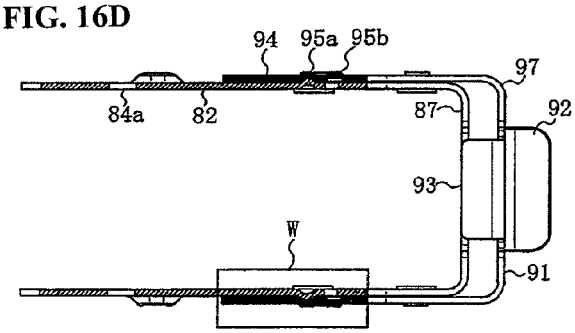

When lock portion 91 is attached to body portion 82, body portions 77*a* are inserted into guide holes 86 from the inside of leg parts 84. Moreover, caulking portions 77*b* at the distal ends of respective body portions 77*a* are inserted into corresponding pin attachment holes 94*a* of leg parts 94 from the inside of leg parts 94. Furthermore, positioning convexed latch-portions 85*a* are engaged with first or second positioning concaved latch-portions 95*a*, 95*b*. In addition, as illustrated in FIGS. 15A and 16A, a caulking processing is applied to caulking portions 77*b* inserted into pin attachment holes 94*a*, so that caulking portions 77*b* are plastically deformed to be enlarged in an outer diameter thereof and finally fixed to leg parts 94. With this operation, lock portion 91 is attached to body portion 82 to be slidable with respect to hood 21.

In the states illustrated in FIGS. 13 and 15A-E, lock portion 91 is positioned at the lock position with respect to body portion 82. In this case, positioning convexed latch-portion 85*a* is engaged to first positioning concaved latch-portion 95*a* close to connection portion 97, so that lock portion 91 is latched at the lock position with respect to body portion 82. At the lock position, lock portion 91 is positioned at a position close to pin insertion hole 84*a*, and latching portion 93 is in a state where it projects further inward than connection portion 87, i.e., in a direction toward pin insertion hole 84*a*. Slide pin 77, close to pin insertion hole 84*a*, comes into tight contact with an end portion of guide hole 86 close to pin insertion hole 84*a*.

Figure 14:
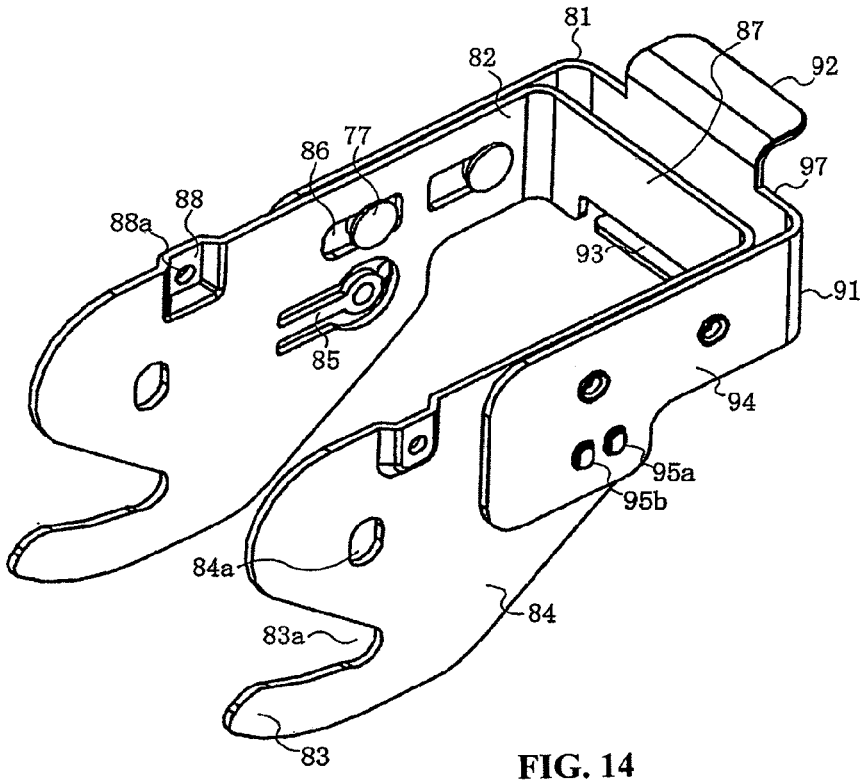
FIG. 14 is a perspective view of the lever of the cable-side connector according to an embodiment of the Present Invention, illustrating the state where the lever is positioned at a lock release position thereof.

On the other hand, in the states illustrated in FIGS. 14 and 16AE, lock portion 91 is positioned at the lock release position with respect to body portion 82. In this case, positioning convexed latch-portion 85*a* is engaged to second positioning concaved latch-portion 95*b* at a side opposite connection portion 97, so that lock portion 91 is latched at the lock release position with respect to body portion 82. At the lock release position, lock portion 91 is positioned at a position opposite pin insertion hole 84*a*, and latching portion 93 is in a state where it does not project further than connection portion 87 in a direction toward pin insertion hole 84*a*. Slide pin 77, at a side opposite to pin insertion hole 84*a*, comes into tight contact with an end portion of guide hole 86 close to pin insertion hole 84*a*.

Figure 21:
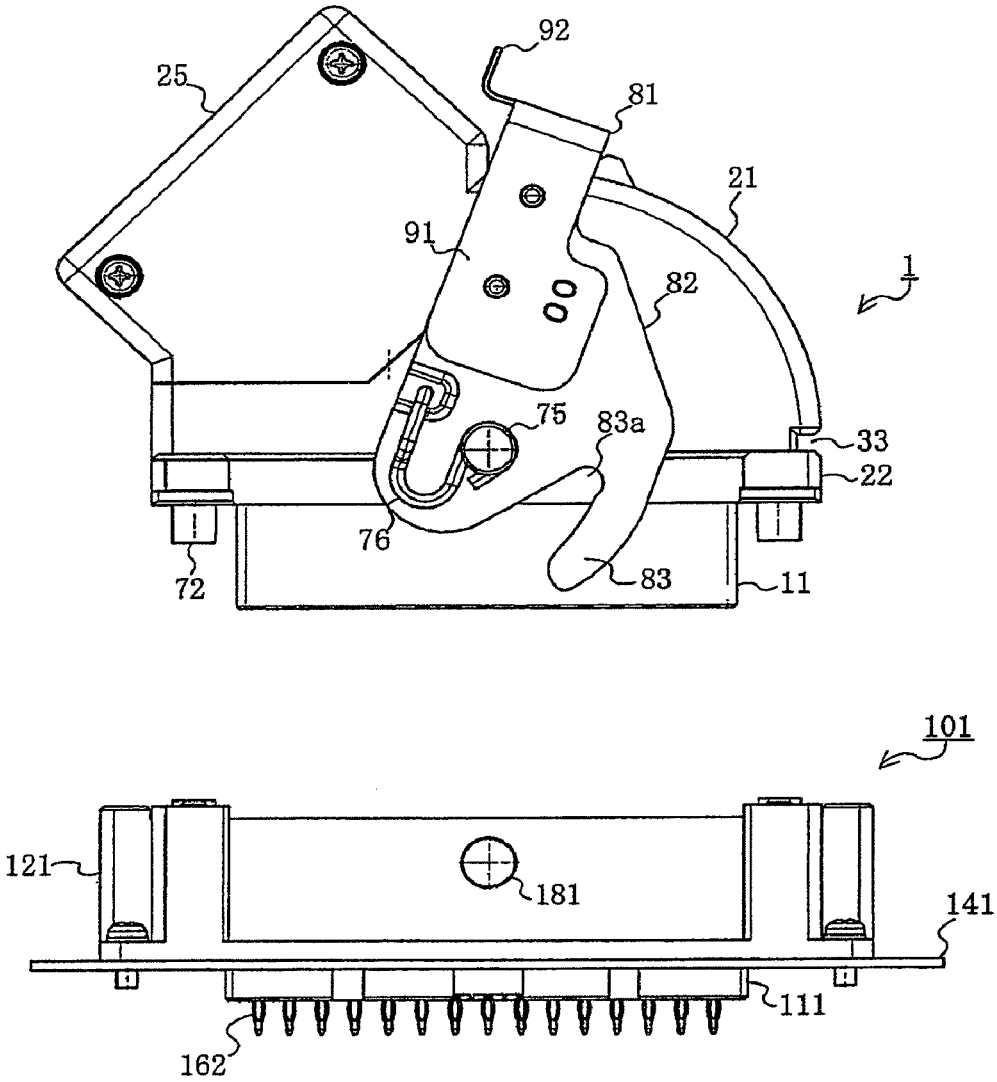
FIG. 21 is a first view illustrating the operation of tightly fitting the cable-side connector to be engaged with the counterpart connector, according to an embodiment of the Present Invention.

Referring to FIGS. 21-7, a description of the operation of tightly fitting cable connector 1 having the above-described structure engaged to board connector 101 will be disclosed. When cable connector 1 and board connector 101 are engaged to each other, the operator may hold cable connector 1 in such a manner as to establish a posture, as illustrated in FIG. 21, where a fitting surface (the lower surface in FIG. 21) of cable connector 1 opposes a fitting surface (the upper surface in FIG. 21) of board connector 101. Moreover, lever 81 is preliminarily set to the initial position, and lock portion 91 is set to the lock position. With this operation, leg parts 84, 94 (disposed on the rear surface side of hood 21) are in tight contact with initial position protrusive abutting portion 34, making lever 81 is unable to rotate in the counter-clockwise direction. Furthermore, since latching portion 93 is latched at initial position latching portion 31, lever 81 is unable to rotate in the clockwise direction. That is, by having lever 81 positioned at an initial position and lock portion 91 positioned at a lock position, lever 81 is in a standstill state while being unable to rotate in both directions. Therefore, it is easy to handle cable connector 1.

Then, the operator moves connectors 1, 101 together so that receptacle housing 11 is inserted into concave fitting portion 113. At the same time, guide portion 71*a* is inserted into guide hole 72*a*, so that guide portion 71*a* is inserted into guide hole 72*a*.

Here, as illustrated in FIG. 3, guide pins 71 and guide bushes 72 are arranged in an asymmetrical relation. In the example illustrated in FIG. 3, in cable connector 1, guide pins 71 are arranged on a rear surface side thereof, and guide bushes 72 are arranged on a front surface side thereof. Meanwhile, in board connector 101, guide pins 71 are arranged on a front surface side thereof, and guide bushes 72 are arranged on a rear surface side thereof. In this manner, since guide pins 71 and guide bushes 72 are arranged in an asymmetrical relation, cable connector 1 might not be able to be tightly fitted to board connector 101 in a direction other than a predetermined direction. That is, in the example illustrated in FIG. 21, when cable connector 1 is directed to a direction where cable lead-out portion 25 is positioned at a right side thereof, guide pins 71 are opposed to guide pins 71. Hence, cable connector 1 is unable to be fitted to board connector 101. That is, by arranging guide pins 71 and guide bushes 72 in an asymmetrical relation, the fitting direction of cable connector 1 with board connector 101 has a polarity. Thus, when cable connector 1 is tightly fit to board connector 101, the corresponding relationship between receptacle terminals 61 and plug terminals 161 is maintained.

Figure 22:
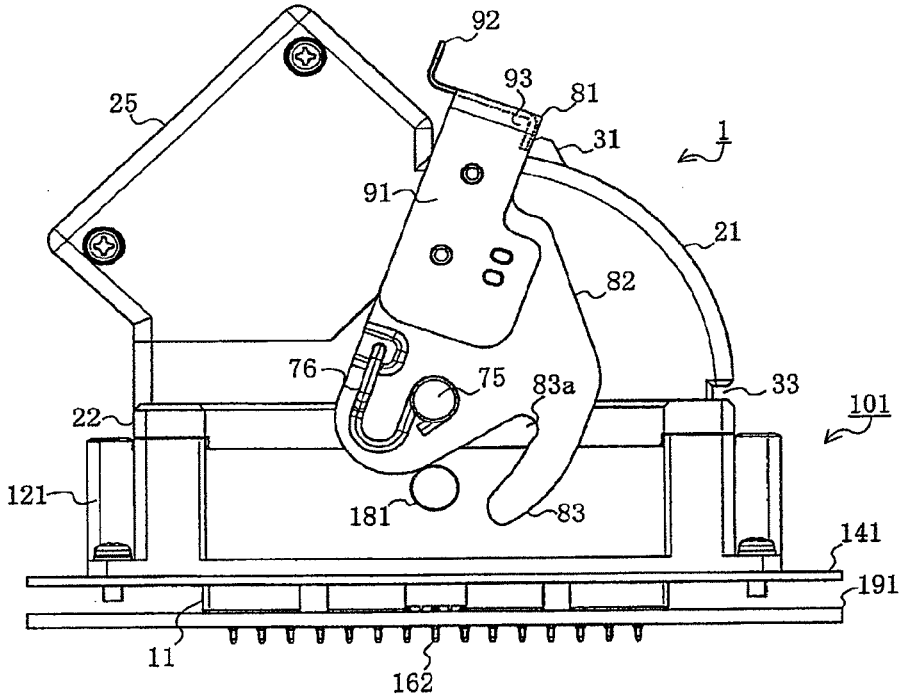
FIG. 22 is a second view illustrating the operation of tightly fitting the cable-side connector to be engaged with the counterpart connector, according to an embodiment of the Present Invention.

When receptacle housing 11 is completely inserted in concave fitting portion 113 so that guide portions 71*a* are completely inserted into guide holes 72*a*, a state illustrated in FIG. 22 is obtained. In this state, plug terminals 161 enter into the corresponding terminal receiving holes 13 to be brought into electrical contact with corresponding receptacle terminals 61.

Subsequently, an operator may moves lock portion 91 to be slid relative to body portion 82, so that lever 81 is displaced from the lock position, illustrated in FIG. 22, to the lock release position, illustrated in FIG. 23. With this operation, the distance from lever lock pin 75 to latching portion 93 becomes longer so that the engagement between latching portion 93 and initial position latching portion 31 is released. Therefore, lever 81 is now able to be rotated in the clockwise direction, as illustrated in FIG. 21.

Figure 15E:
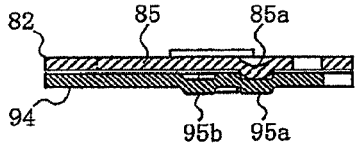
Figure 16E:
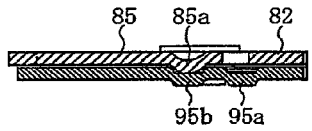
Figure 17A:
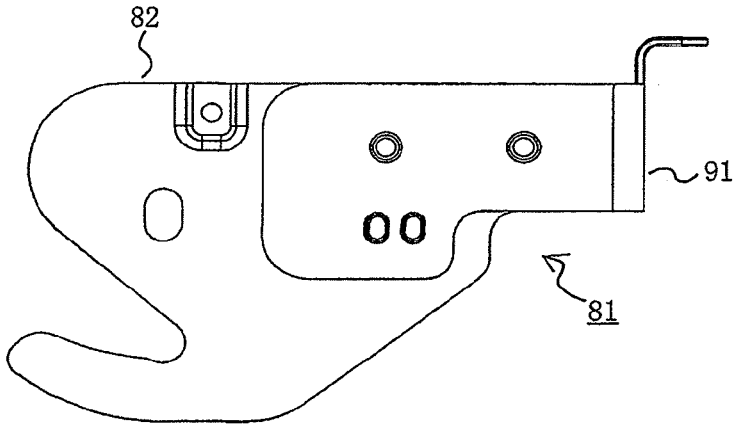
Figure 17B:
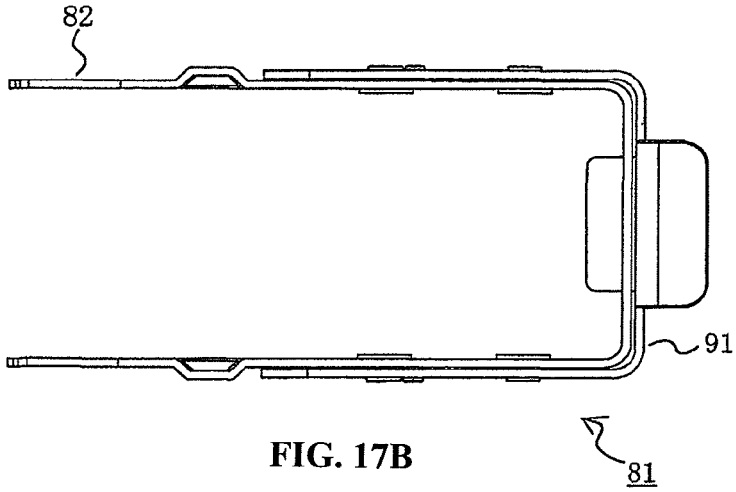
Figure 17C:
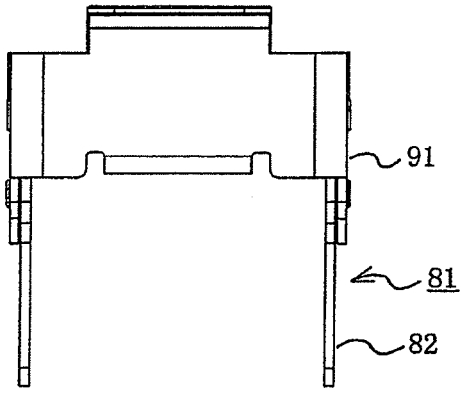
Figure 18A:
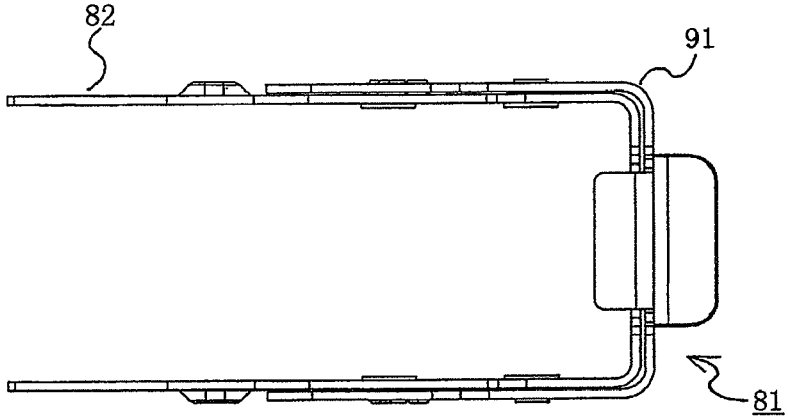
Figure 18B:
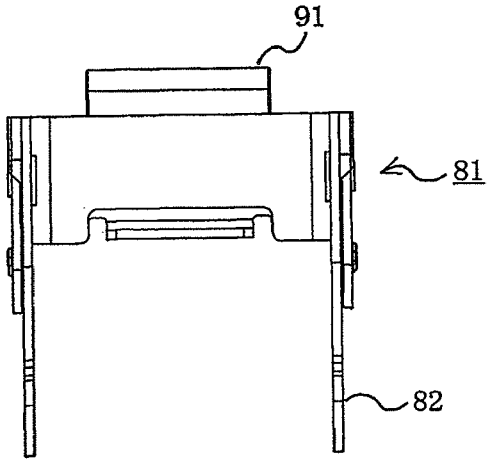
Figure 18C:
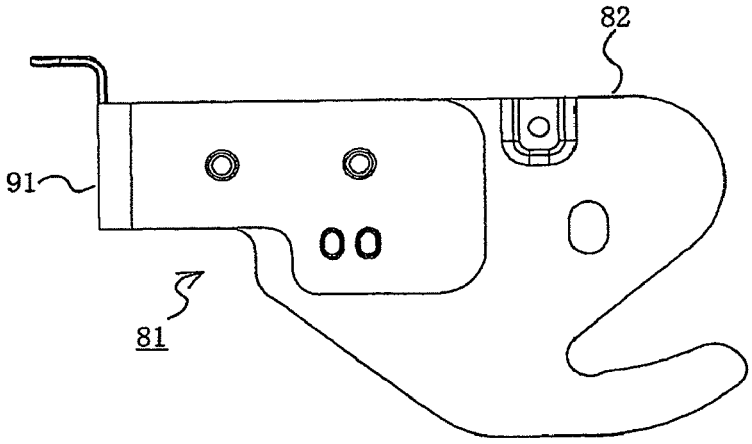
Figure 19A:
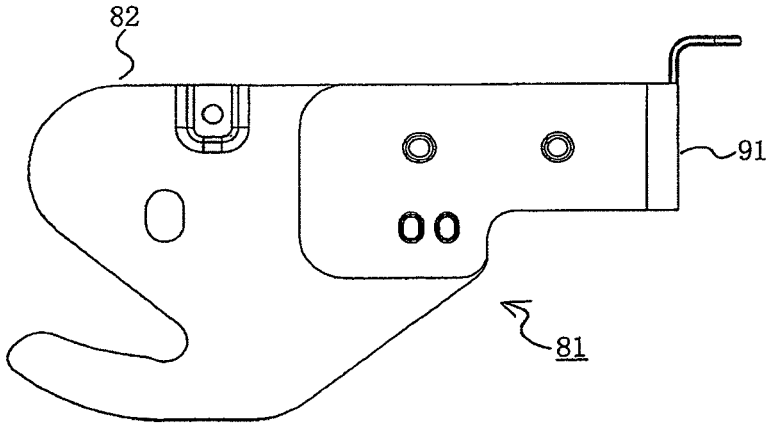
Figure 19B:
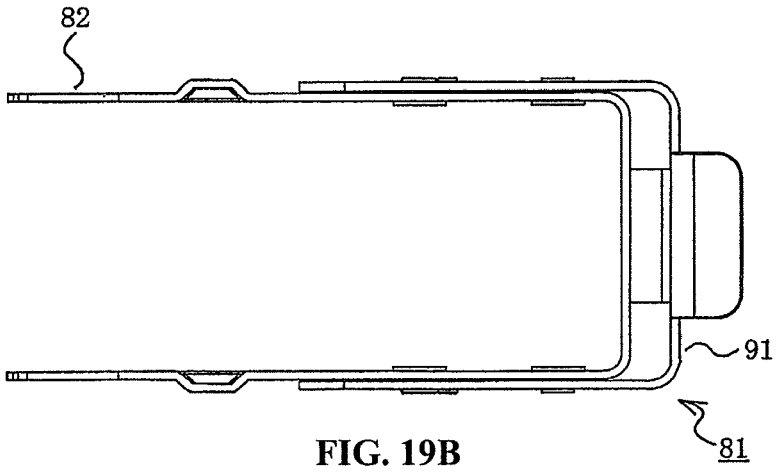
Figure 19C:
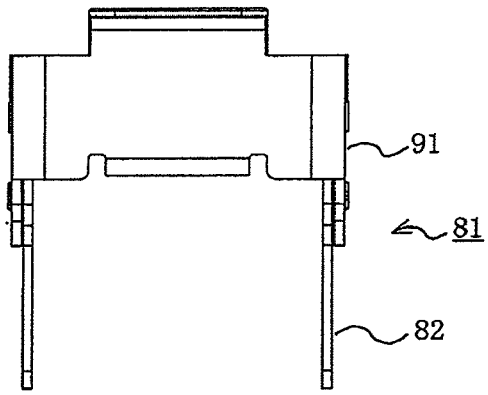
Figure 20A:
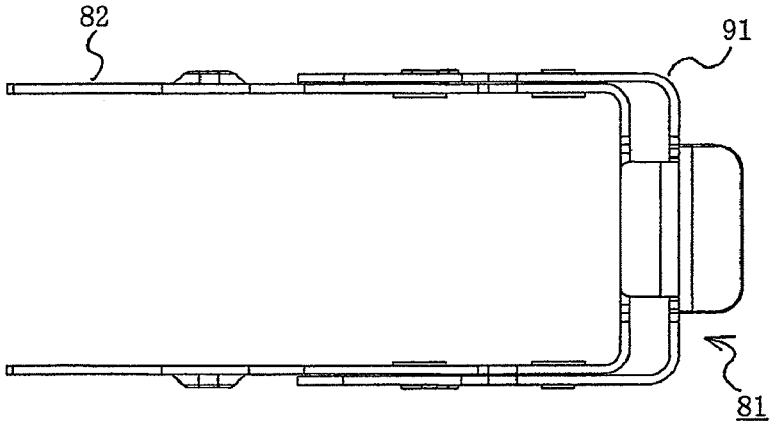
Figure 20B:
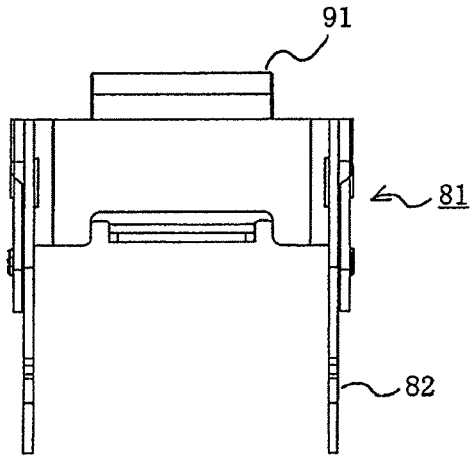
Figure 20C:
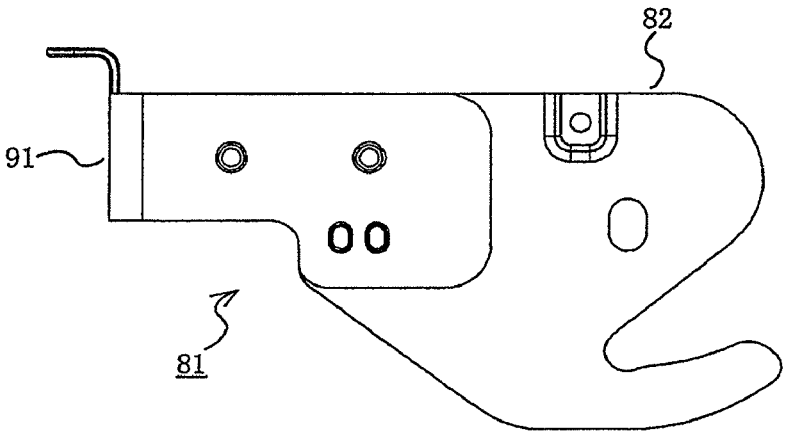

At this time, and as illustrated in FIG. 15E, the engagement between positioning convexed latch-portion 85*a* and first positioning concaved latch-portion 95*a* is released, and, as illustrated in FIG. 16E, the engagement between positioning convexed latch-portion 85*a* and second positioning concaved latch-portion 95*b* is established. Therefore, an operator can perceive a click-feeling. Moreover, the operator may be able to recognize that lock portion 91 is latched at the lock release position with respect to body portion 82, without needing to have a look at lock portion 91 to see the position thereof relative to body portion 82. For this reason, the operator can rotate lever 81 in the clockwise direction in FIG. 23 regardless of where lever 81 is.

Figure 23:
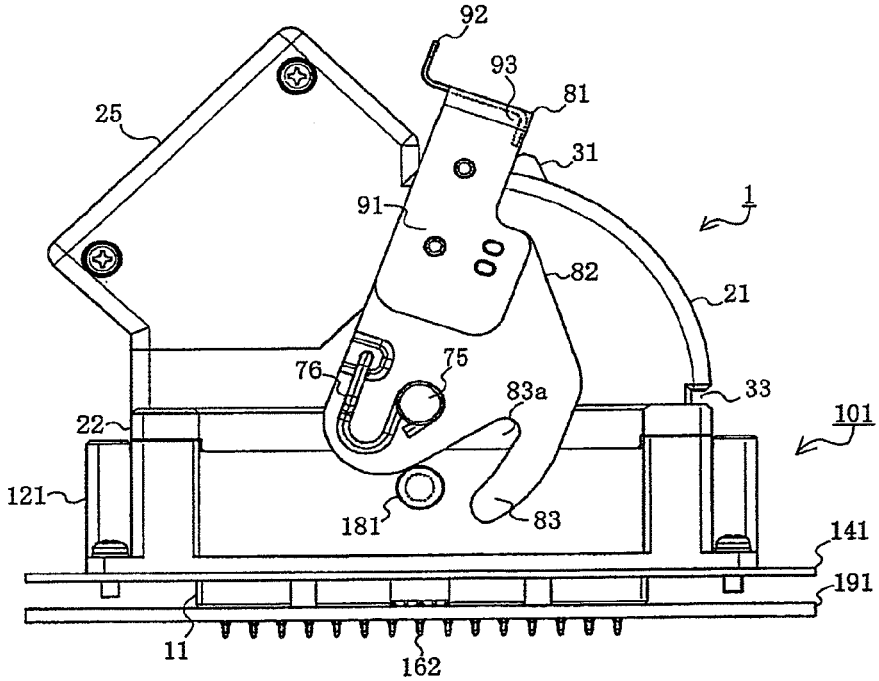
FIG. 23 is a third view illustrating the operation of tightly fitting the cable-side connector to be engaged with the counterpart connector, according to an embodiment of the Present Invention.
Figure 24:
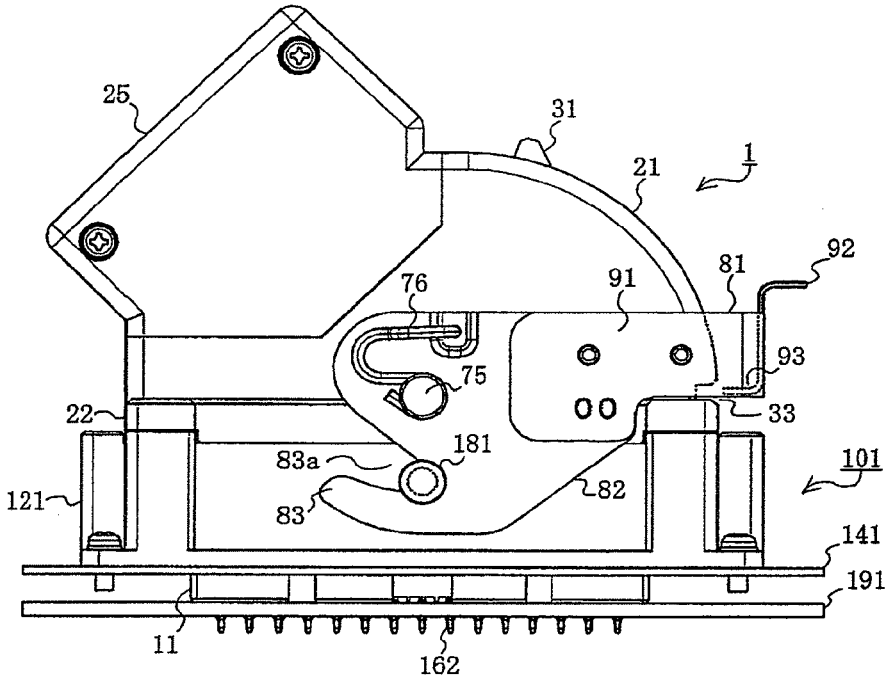
FIG. 24 is a fourth view illustrating the operation of tightly fitting the cable-side connector to be engaged with the counterpart connector, according to an embodiment of the Present Invention.

When lever 81 is rotated in the clockwise direction in FIG. 23, lock pin 181, attached to enclosure 121, is displaced relative to lever 81 to be engaged by entering into concave engagement portion 83*a*. When lever 81 reaches the fitting completion position as illustrated in FIG. 24, leg parts 84, 94 are brought into tight contact with bottom portion 22 to be unable to be rotated or moved. Moreover, since lock portion 91 is positioned at the lock release position until it reaches the fitting completion position, latching portion 93 does not interfere with any portion of rear surface portion 23*a*, and lever 81 can be smoothly rotated. When lever 81 reaches the fitting completion position, lock pin 181 reaches the deepest portion of concave engagement portion 83*a*. Therefore, the engagement state between lock pin 181 and concave engagement portion 83*a* becomes firm and is not easily released. Thus, the engagement state between cable connector 1 and board connector 101 becomes unable to be released.

Figure 25:
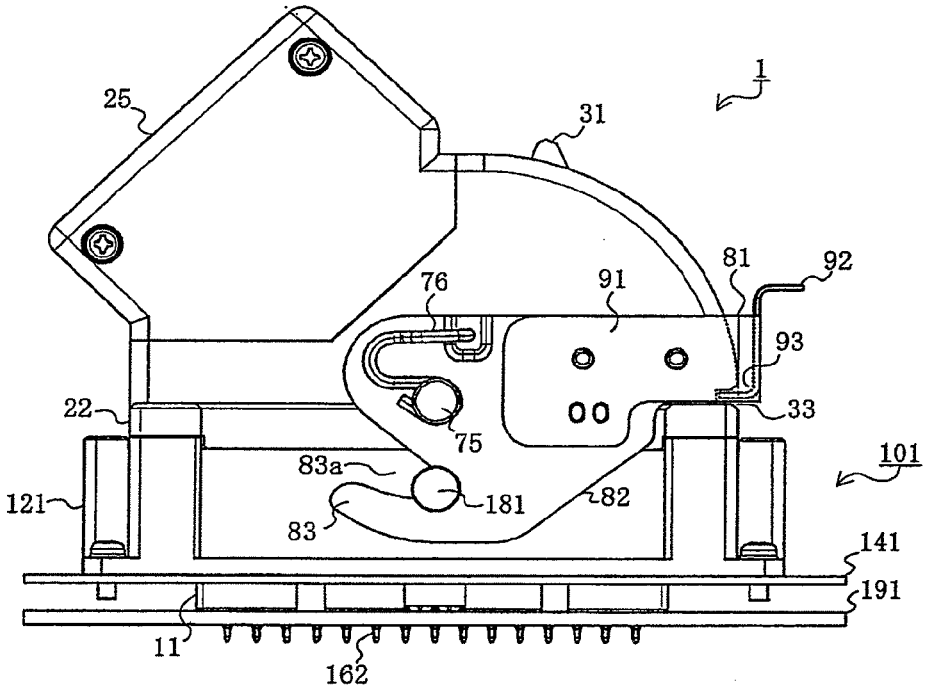
FIG. 25 is a fifth view illustrating the operation of tightly fitting the cable-side connector to be engaged with the counterpart connector, according to an embodiment of the Present Invention.
Figure 26:
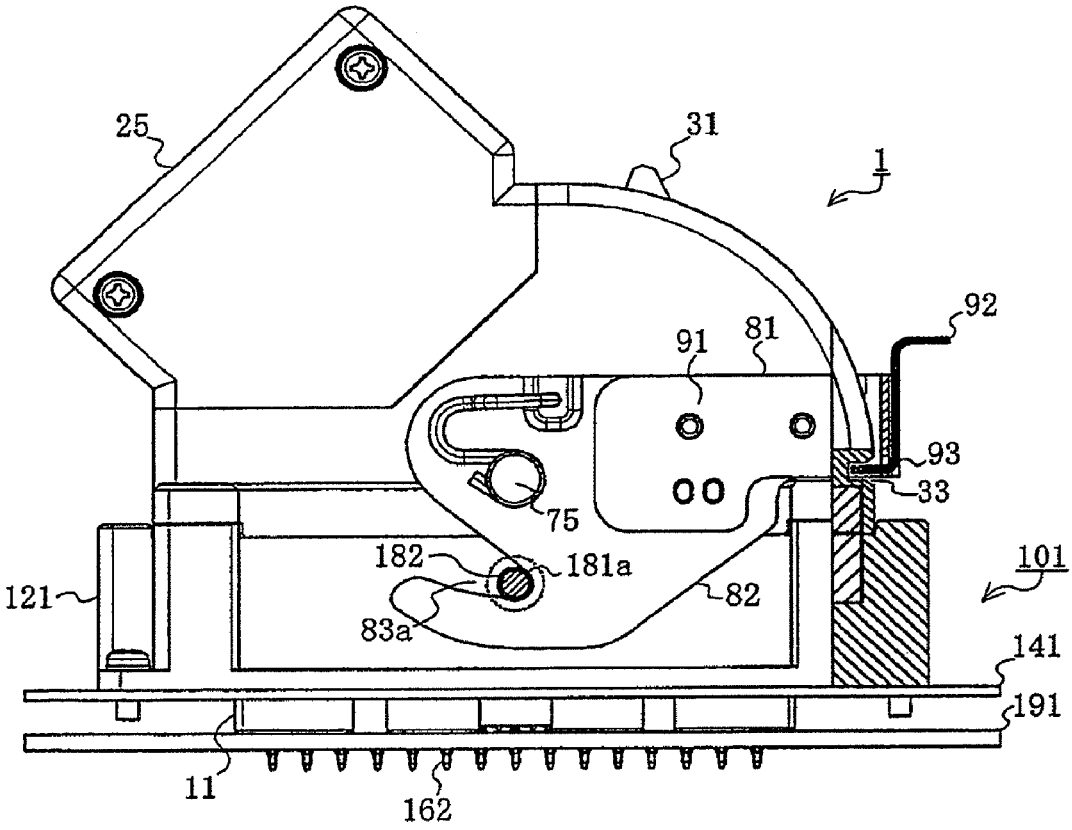
FIG. 26 is a front elevation view, in part cross-sectioned, illustrating a state where the engagement of the cable-side connector with the counterpart connector is completed according to an embodiment of the Present Invention.
Figure 27:
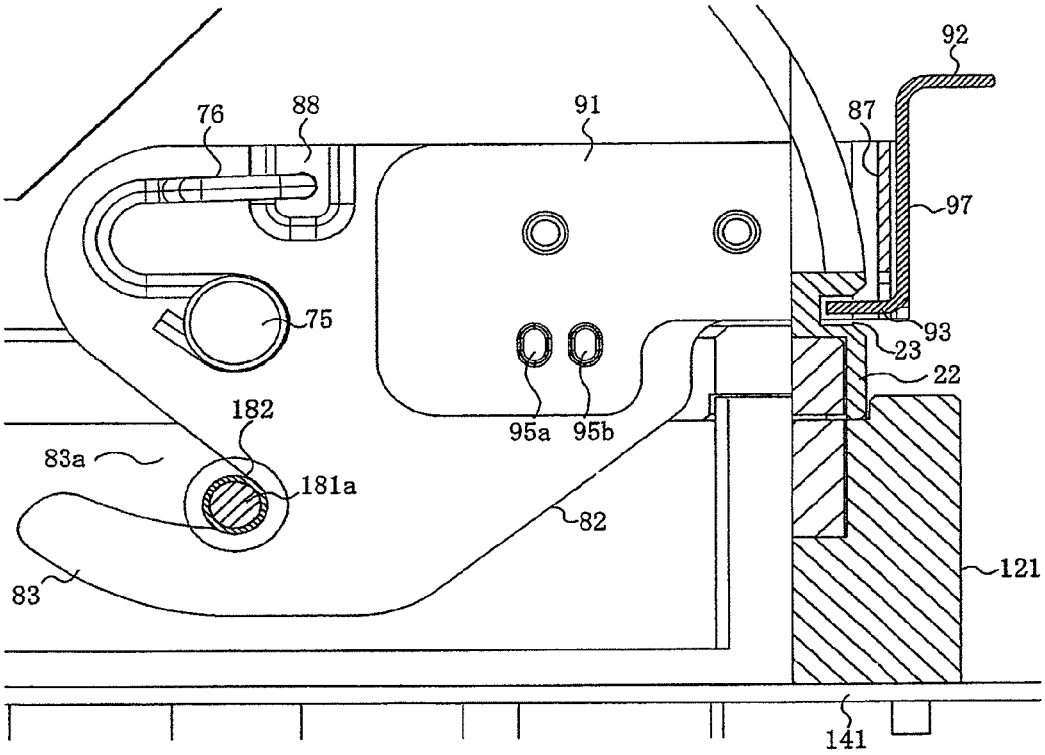
FIG. 27 is an enlarged view of a main part of FIG. 26, illustrating the main part when the engagement of the cable-side connector with the counterpart connector is completed according to an embodiment of the Present Invention.
Figure 28:
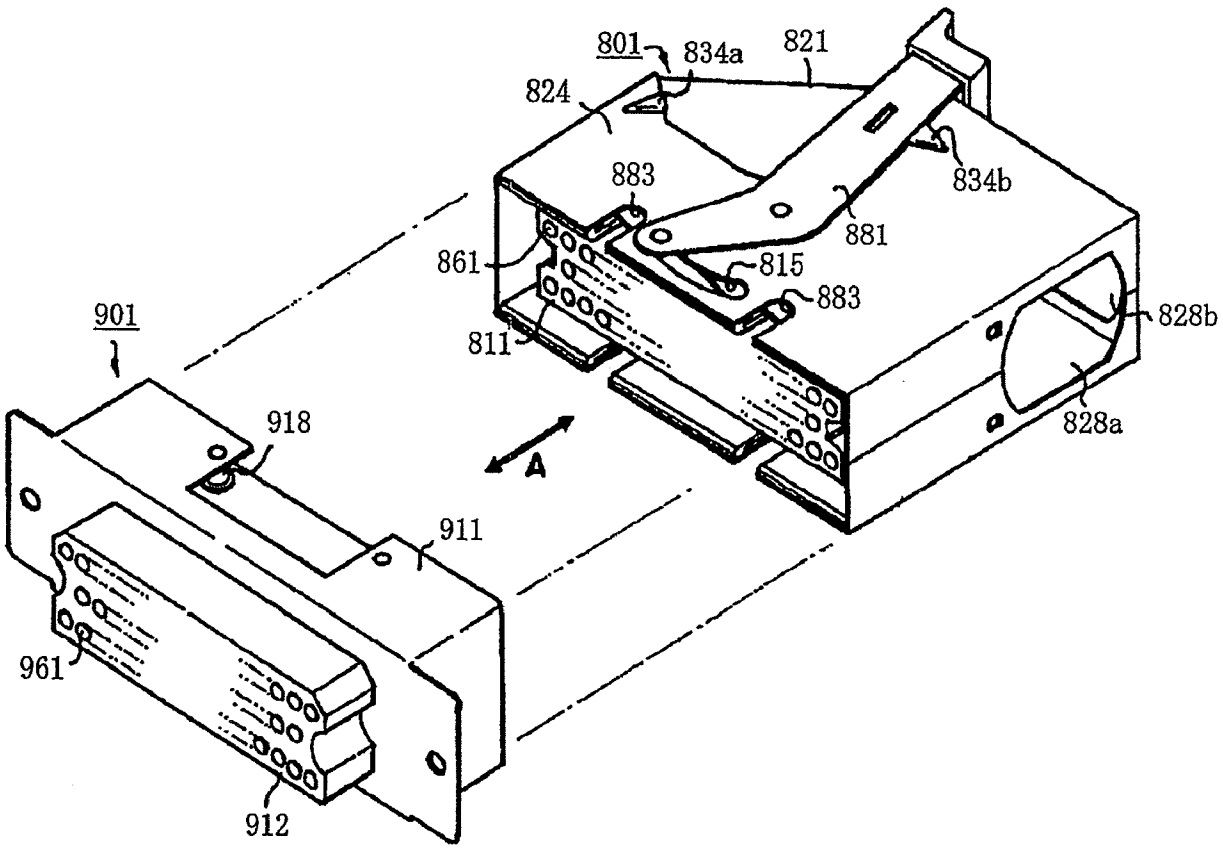
Prior art FIG. 28
FIG. 28 is a perspective view of a conventional connector and a counterpart connector, according to an embodiment of the Present Invention.

Subsequently, the operator slides lock portion 91 relative to body portion 82, so that lever 81 is displaced from the lock release position as illustrated in FIG. 24 to the lock position as illustrated in FIG. 25. With this operation, the distance from lever lock pin 75 to latching portion 93 becomes shorter, so that, as illustrated in detail in FIGS. 26-7, latching portion 93 is engaged by entering into groove-shaped fitting completion position latching portion 33 formed at the boundary portion between rear surface portion 23*a* and bottom portion 22. For this reason, lever 81 is locked at hood 21 at the fitting completion position, and becomes unable to rotate.

At this time, as illustrated in FIG. 16E, the engagement between positioning convexed latch-portion 85*a* and second positioning concaved latch-portion 95*b* is released, and, as illustrated in FIG. 15E, the engagement between positioning convexed latch-portion 85*a* and first positioning concaved latch-portion 95*a* is established. Therefore, an operator can perceive a click-feeling. Moreover, the operator may be able to recognize that lock portion 91 is latched at the lock position with respect to body portion 82 without necessity to intentionally look at lock portion 91 to confirm by sight the position thereof relative to body portion 82.

When lever 81 is positioned at a position other than the fitting completion position, except the initial position, latching portion 93 interferes with rear surface portion 23*a*. Therefore, lock portion 91 is unable to be displaced to the lock position. For this reason, the operator can recognize that lever 81 is locked at the fitting completion position by determining that lock portion 91 is latched at the lock position with respect to body portion 82 based on the perceived click-feeling when positioning convexed latch-portion 85*a* is engaged with first positioning concaved latch-portion 95*a*. Therefore, the operator can recognize that the engagement between cable connector 1 and board connector 101 is completely carried out.

Further, positioning convexed latch-portion 85*a* engages with first positioning concaved latch-portion 95*a*, so that lock portion 91 is latched at the lock position with respect to body portion 82. Therefore, even when an external force is applied to cable connector 1 or board connector 101, lock portion 91 will not be displaced from the lock position. Therefore, latching portion 93 remains at a state where it is latched to fitting completion position latching portion 33. Hence, lever 81 remains at a state where it is locked at hood 21 at the fitting completion position and unable to rotate. Therefore, the lock of lever 81 is not unnecessarily released, and thus the engagement state between cable connector 1 and board connector 101 can be maintained.

Moreover, as illustrated in FIGS. 24-7, when lever 81 is positioned at the fitting completion position, as described above, lever spring 76 applies an urging force capable of broadening the distance between pin insertion hole 84*a* and lever lock pin 75. Moreover, since pin insertion hole 84*a* has a vertically long ellipsoid, or oval, shape, lever 81 is upwardly urged with respect to lever lock pin 75. Therefore, lock pin 181 is upwardly urged by engagement arm portion 83. Thus, the engagement state between cable connector 1 and board connector 101 can be maintained in a more stable manner.

When the engagement between cable connector 1 and board connector 101 is released, an operation opposite to the above-described operation for tightly fitting cable connector 1 to board connector 101 is performed to release the engagement between cable connector 1 and board connector 101 so that cable connector 1 is removed from board connector 101. Moreover, cable connector 1 may be removed from board connector 101, since lever 81 is positioned at the initial position and lock portion 91 is positioned at the lock position. Thus, lever 81 is unable to rotate in both directions. For this reason, it is easy to handle cable connector 1.

As described above, connector 1 includes receptacle housing 11 and hood 21, being configured to receive receptacle terminals 61. Lever 81 is rotatably attached to hood 21 and configured to be rotatable between the initial position, initially fitted to board connector 101, and the fitting completion position, where the fitting to board connector 101 is completed. Lock portion 91 is capable of locking lever 81 at the second position, is slidably attached to body portion 82, and is configured to slide between the lock position where lever 81 is locked, and the lock release position, where the lock is released. Lever 81 is provided with positioning convexed latch-portion 85*a*, first positioning concaved latch-portion 95*a* and second positioning concaved latch-portion 95*b*—being configured to latch lock portion 91 at the lock position and the lock release position. Positioning convexed latch-portion 85*a* is configured to be elastically displaced to engage or disengage first and second positioning concaved latch-portion 95*a*, 95*b*.

With this arrangement, lever 81 becomes unable to rotate by being locked at the fitting completion position, and lock portion 91 might not slide from the lock position. Thus, the lock is not unnecessarily released. Therefore, even when an external force is applied, the engagement with board connector 101 is not released. Moreover, since the operator can perceive a click-feeling when lock portion 91 is slid from the lock position and the lock release position, it is possible to prevent an erroneous operation on lock portion 91. Therefore, it is possible to provide good operability and high reliability.

Lever 81 preferably extends in a direction perpendicular to the direction of fitting to board connector 101 at the fitting completion position. With this arrangement, the operator can operate lever 81. Moreover, by operating lever 81, cable connector 1 can be more tightly engaged with board connector 101.

Positioning convexed latch-portion 85*a* is formed at a free end of cantilever-like elastic positioning arm portion 85, having a proximal end thereof being connected to body portion 82. First and second positioning concaved latch-portions 95*a*, 95*b* are formed at lock portion 91. First positioning concaved latch-portion 95*a* is capable of being engaged to positioning convexed latch-portion 85*a* to latch lock portion 91 at the lock position, and second positioning concaved latch-portion 95*b* is capable of being engaged to positioning convexed latch-portion 85*a* to latch lock portion 91 at the lock release position. With this arrangement, since positioning convexed latch-portion 85*a* is elastically deformed to be engaged to or disengaged from first and second positioning concaved latch-portions 95*a*, 95*b*, the operator operating lock portion 91 may be able to perceive a click-feeling.

Lock portion 91 includes operation portion 92, disposed at a rear end of lever 81 and arranged to extend in a direction away from lock pin 181, and a distance from operation portion 92 to lock pin 181 when lock portion 91 is positioned at the lock release position becomes longer than that when lock portion 91 is positioned at the lock position. With this arrangement, the radius of rotation of operation portion 92 increases when lever 81 is rotated in a state where lock portion 91 is positioned at the lock release position. A great rotational torque can be exerted even with a small force being applied to operation portion 92. Thus, the operation of operation portion 81 can be performed easily. Moreover, the amount of protrusion of operation portion 92 is small when lever 81 is not rotated. Thus, it is possible to decrease the overall outside dimension of cable connector 1.

Lock portion 91 includes latching portion 93, disposed at a rear end of lever 81 and arranged to extend in a direction toward lock pin 181, and a distance from latching portion 93 to lock pin 181 when lock portion 91 is positioned at the lock position becomes shorter than that when lock portion 91 is positioned at the lock release position. Further, when lock portion 91 is moved to the lock position (in a state where lever 81 is positioned at the second position), latching portion 93 is latched by coming into fitting completion position latching portion 33. With this arrangement, when lever 81 is rotated in a state where lock portion 91 is positioned at the lock release position, latching portion 93 does not interfere with receptacle housing 11 and hood 21. Moreover, lever 81 can be certainly locked at the fitting completion position by only sliding lock portion 91.

While a preferred embodiment of the Present Invention is shown and described, it is envisioned that those skilled in the art may devise various modifications without departing from the spirit and scope of the foregoing Description and the appended Claims.

What is claimed is:

1. A connector comprising:

a housing which receives therein terminals;

a lever which is rotatably attached to the housing and is configured to be rotatable between a first position where an initial stage of fitting of the connector to a counterpart connector is established and a second position where the fitting thereof to the counterpart connector is completed; and a lock portion which is capable of locking the lever at the second position;

wherein the lock portion is slidably attached to a body portion of the lever and is configured to be slid between a lock position where the lever is locked and a lock release position where the lever is released;

wherein the lever is provided with a positioning latch-portion that is configured to latch the lock portion at the lock position and the lock release position; and wherein the positioning latch-portion is provided with a concaved latch-portion and a convexed latch-portion that is configured to be elastically displaced to be engaged in or disengaged from the concaved latch-portion.

2. The connector according to claim 1:

wherein the lock portion includes a latching portion that is disposed at a rear end of the lever and is arranged to extend in a direction toward a rotation shaft of the lever;

wherein a distance from the latching portion to the rotation shaft when the lock portion is positioned at the lock position becomes shorter than that when the lock portion is positioned at the lock release position; and wherein when the lock portion is moved to the lock position in a state where the lever is positioned at the second position, the latching portion is latched by coming into a lever-latching concave-portion formed in an outer circumference of the housing.

3. The connector according to claim 1:

wherein the lock portion includes an operation portion that is disposed at a rear end of the lever and is arranged to extend in a direction distant away from a rotation shaft of the lever; and wherein a distance from the operation portion to the rotation shaft when the lock portion is positioned at the lock release position becomes longer than that when the lock portion is positioned at the lock position.

4. The connector according to claim 3:

wherein the lock portion includes a latching portion that is disposed at a rear end of the lever and is arranged to extend in a direction toward a rotation shaft of the lever;

wherein a distance from the latching portion to the rotation shaft when the lock portion is positioned at the lock position becomes shorter than that when the lock portion is positioned at the lock release position; and wherein when the lock portion is moved to the lock position in a state where the lever is positioned at the second position, the latching portion is latched by coming into a lever-latching concave-portion formed in an outer circumference of the housing.

5. The connector according to claim 1, wherein the lever is arranged to extend in a direction perpendicular to a direction of fitting to the counterpart connector at the second position.

6. The connector according to claim 5:

wherein the lock portion includes a latching portion that is disposed at a rear end of the lever and is arranged to extend in a direction toward a rotation shaft of the lever;

wherein a distance from the latching portion to the rotation shaft when the lock portion is positioned at the lock position becomes shorter than that when the lock portion is positioned at the lock release position; and wherein when the lock portion is moved to the lock position in a state where the lever is positioned at the second position, the latching portion is latched by coming into a lever-latching concave-portion formed in an outer circumference of the housing.

7. The connector according to claim 5:

wherein the lock portion includes an operation portion that is disposed at a rear end of the lever and is arranged to extend in a direction distant away from a rotation shaft of the lever; and wherein a distance from the operation portion to the rotation shaft when the lock portion is positioned at the lock release position becomes longer than that when the lock portion is positioned at the lock position.

8. The connector according to claim 7:

wherein the lock portion includes a latching portion that is disposed at a rear end of the lever and is arranged to extend in a direction toward a rotation shaft of the lever;

wherein a distance from the latching portion to the rotation shaft when the lock portion is positioned at the lock position becomes shorter than that when the lock portion is positioned at the lock release position; and wherein when the lock portion is moved to the lock position in a state where the lever is positioned at the second position, the latching portion is latched by coming into a lever-latching concave-portion formed in an outer circumference of the housing.

9. The connector according to claim 1:

wherein the convexed latch-portion is formed in a free end of a cantilever-like elastic positioning arm portion having a proximal end thereof connected to the body portion; and wherein the concaved latch-portion is formed in the lock portion and includes a first positioning concaved latch-portion capable of being engaged with the latching convex-portion to latch the lock portion at the lock position and a second positioning concaved latch-portion capable of being engaged with the convexed latch-portion to latch the lock portion at the lock release position.

10. The connector according to claim 9:

wherein the lock portion includes a latching portion that is disposed at a rear end of the lever and is arranged to extend in a direction toward a rotation shaft of the lever;

wherein a distance from the latching portion to the rotation shaft when the lock portion is positioned at the lock position becomes shorter than that when the lock portion is positioned at the lock release position; and wherein when the lock portion is moved to the lock position in a state where the lever is positioned at the second position, the latching portion is latched by coming into a lever-latching concave-portion formed in an outer circumference of the housing.

11. The connector according to claim 9:

wherein the lock portion includes an operation portion that is disposed at a rear end of the lever and is arranged to extend in a direction distant away from a rotation shaft of the lever; and wherein a distance from the operation portion to the rotation shaft when the lock portion is positioned at the lock release position becomes longer than that when the lock portion is positioned at the lock position.

12. The connector according to claim 11:

wherein the lock portion includes a latching portion that is disposed at a rear end of the lever and is arranged to extend in a direction toward a rotation shaft of the lever;

wherein a distance from the latching portion to the rotation shaft when the lock portion is positioned at the lock position becomes shorter than that when the lock portion is positioned at the lock release position; and wherein when the lock portion is moved to the lock position in a state where the lever is positioned at the second position, the latching portion is latched by coming into a lever-latching concave-portion formed in an outer circumference of the housing.

* * * * *